US010134572B2

(12) United States Patent
Laskin et al.

(10) Patent No.: US 10,134,572 B2
(45) Date of Patent: Nov. 20, 2018

(54) TECHNIQUES FOR CONTROLLING DISTANCE BETWEEN A SAMPLE AND SAMPLE PROBE WHILE SUCH PROBE LIBERATES ANALYTE FROM A SAMPLE REGION FOR ANALYSIS WITH A MASS SPECTROMETER

(71) Applicant: BATTELLE MEMORIAL INSTITUTE, Richland, WA (US)

(72) Inventors: Julia Laskin, Richland, WA (US); Son N. Nguyen, Richland, WA (US); Andrey V. Liyu, Pasco, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 15/225,585

(22) Filed: Aug. 1, 2016

(65) Prior Publication Data

US 2018/0033597 A1 Feb. 1, 2018

Related U.S. Application Data

(60) Provisional application No. 62/343,816, filed on May 31, 2016.

(51) Int. Cl.
*H01J 49/00* (2006.01)
*H01J 49/04* (2006.01)

(52) U.S. Cl.
CPC ..... *H01J 49/0027* (2013.01); *H01J 49/0004* (2013.01); *H01J 49/0409* (2013.01)

(58) Field of Classification Search
CPC ..... H01J 49/0027; H01J 49/0004; H01J 49/0409

(Continued)

(56) References Cited

U.S. PATENT DOCUMENTS 7,335,897 B2 2/2008 Takats et al.
7,858,928 B2 12/2010 Knapp
(Continued)

OTHER PUBLICATIONS

Khaled Karrai et al., "Tip-Sample Distance Control for Near-Field Scanning Optical Microscopes" Proc. SPIE (Proceedings of the Society of Photo-Optical Instrumentation Engineers), Sep. 6, 1995, pp. 69-81, vol. 2535.

(Continued)

*Primary Examiner* — Nicole Ippolito
*Assistant Examiner* — Hanway Chang
(74) *Attorney, Agent, or Firm* — Wells St. John P.S.

(57) ABSTRACT

A system includes a mass spectrometer and associated sample interfacing equipment. The sample interfacing equipment includes a platform structured to support a sample thereon, a fluid source, a high voltage source, a dispensing probe electrically coupled to the high voltage source and defining a fluid dispensing passage therethrough, a collection probe defining a collection passage therethrough, a sensing arrangement coupled to the dispensing probe, and control logic responsive to the sensing arrangement to control distance between the dispensing probe and the sample. The dispensing probe facilitates formation of one or more ionized sample analytes when dispensing the fluid through the dispensing passage proximate to the sample on the platform. The collecting probe receives at least some of the one or more ionized sample analytes to pass through the collection passage into the mass spectrometer for analysis.

21 Claims, 10 Drawing Sheets

(58) Field of Classification Search
USPC ..... 250/281, 282, 288
See application file for complete search history.

(56) References Cited

U.S. PATENT DOCUMENTS

| | | | | |
|---|---|---|---|---|
| 8,076,893 | B2 | 12/2011 | Dong et al. | |
| 8,097,845 | B2 | 1/2012 | Roach et al. | |
| 9,064,680 | B2 * | 6/2015 | Van Berkel | G01Q 30/14 |
| 2013/0080073 | A1 | 3/2013 | de Corral | |
| 2016/0203968 | A1 * | 7/2016 | Otsuka | G01B 11/26 250/288 |

OTHER PUBLICATIONS

Angela Jones et al., "Environment and Nanotechnology" University of Wisconsin-Madison Nanoscale Science & Engineering Center, published at least as early as Oct. 2015, appears to be a presentation hard copy but not overtly indicated as such, (document was last modified on or about Feb. 12, 2013 according to embedded document properties).

Si Wu et al.,"Incorporation of a Flared Inlet Capillary Tube on a Fourier Transform Ion Cycltron Resonance Mass Spectrometer" Journal of the American Society for Mass Spectrometry, Apr. 17, 2006, pp. 772-779, vol. 17, Published by Elsevier Inc.

A.G.T. Ruiter et al., "Tuning Fork Shear-Force Feedback" Ultramicroscopy, 1998, pp. 149-157, vol. 71, Published by Elsevier Science B.V.

Daniel Haefliger et al., "An Integrated Piezo-Acoustic Sher-Force Distance Sensor With Nanometer Resolution for a Micropipetter Tool" Sensors and Actuators A, 2003, pp. 353-358, vol. 103, Published by Elsevier Science B.V.

E. Bosma et al., "Large Scale Scanning Probe Microscope: Making the Shear-Force Scanning Visible" American Journal of Physics, Jun. 2010, pp. 562-566, vol. 78.

Francois O. LaForge et al., "Nanoscale Imaging of Surface Topography and Reactivity With the Scanning Electrochemical Microscope" Analytical Chemistry, Mar. 12, 2009, pp. 3143-3150, vol. 81, No. 8, Published by American Chemical Society.

Peter Nemes et al., "Ambient Mass Spectrometry for In Vivo Local Analysis and In Situ Molecular Tissue Imaging" Trends in Analytical Chemistry, 2012, pp. 22-34, vol. 34, Published by Elsevier LTD.

Jeramie Watrous et al., "Metabolic Profiling Directly From The Petri Dish Using Nanodesi Imaging Mass Spectrometry" Analytical Chemistry, Nov. 5, 2013, pp. 10385-10391, vol. 85(21), NIH-PA Author Manuscript, available in PMC Nov. 5, 2014, Published by American Chemical Society and/or National Institutes of Health?

Livia S. Eberlin et al., "Desi and Maldi Mass Spectrometry Imaging of Lipid and Protein Distributions in Single Tissue Sections" Analytical Chemistry, Nov. 15, 2011, pp. 8366-8371, vol. 83(22), NIH-PA Author Manuscript, available in PMC Nov. 15, 2012, Published by American Chemical Society and/or National Institutes of Health?

Matthew F. Traxler et al., "A Massively Spectacular View of the Chemical Lives of Microbes" Proceedings of the National Academy of Sciences (PNAS), Jun. 26, 2012, pp. 10128-10129, vol. 109, No. 26.

Jeramie Watrous et al., "Mass Spectral Molecular Networking of Living Microbial Colonies" Proceedings of the National Academy of Sciences (PNAS), Published online May 14, 2012, pp. E1743-E1752.

Prosolia Inc. [no natural person was otherwise evident as an author], "Desi Ion Sources (Desorption Electrospray Ionization" published at least as early as Oct. 2015, online brochure, www.prosolia.com website filename: Prosolia_2012_DESI_Product_Brochure.pdf (pdf document properties indicate date of creation and date of last modification both as May 10, 2012).

Zoltan Takats et al., "Mass Spectrometry Sampling Under Ambient Conditions With Desorption Electrospray Ionization" Science, Oct. 15, 2004, pp. 471-473, vol. 306.

Jorge Otero et al., "Nanocharacterization of Soft Biological Samples in Shear Mode With Quartz Tuning Fork Probe" Sensors, Apr. 12, 2012, pp. 4803-4819, vol. 12, Published by MDPI (Multidisciplinary Digital Publishing Institute).

C. Durkan et al., "Study of Shear Force As a Distance Regulation Mechanism for Scanning Near-Field Optical Microsopy" Journal of Applied Physics, Feb. 1, 1996, pp. 1219-1223, vol. 79 (3), Published by American Institute of Physics?

Julia Laskin et al., "Tissue Imaging Using Nanospray Desorption Electrospray Ionizatio Mass Spectrometry" Analytical Chemistry, Jan. 3, 2012, pp. 141-148, vol. 84(1), NIH-PA Author Manuscript, available in PMC Jan. 3, 2013, Published by American Chemical Society and/or National Institutes of Health?

* cited by examiner

TECHNIQUES FOR CONTROLLING DISTANCE BETWEEN A SAMPLE AND SAMPLE PROBE WHILE SUCH PROBE LIBERATES ANALYTE FROM A SAMPLE REGION FOR ANALYSIS WITH A MASS SPECTROMETER

CROSS-REFERENCE TO RELATED PATENT APPLICATIONS

The present application claims the benefit of U.S. Provisional Patent Application No. 62/343,816 filed 31 May 2016, which is hereby incorporated by reference as if set-forth in its entirety herein.

STATEMENT REGARDING RIGHTS TO INVENTION MADE UNDER FEDERALLY-SPONSORED RESEARCH AND DEVELOPMENT

This invention was made with Government support under Contract DE-AC05-76RL01830 awarded by the U.S. Department of Energy and Grant 5R21ES024229-02 awarded by the National Institutes of Health. The Government has certain rights in the invention.

BACKGROUND

There is a persistent desire to perform faster, cheaper, and more accurate characterization of materials to enhance scientific understanding of the same. Compositional analysis is one focus of such characterization. Another area of leading interest is in the visualization of substances that compositionally vary with location, shape, spatial configuration, or the like—especially those of a biological nature that potentially provide better insight into disease treatment. At the same time, analysis that can be performed under ambient atmospheric conditions with little or no sample preparation time is desirable. For instance, Desorption ElectroSpray Ionization (DESI) recently has simplified preparation of samples undergoing compositional analysis by mass spectrometer. Among other sources, DESI is described in U.S. Pat. No. 7,335,897 B2 to Tákats et al. that issued 26 Feb. 2008—which is hereby incorporated by reference as if set forth in its entirety herein. Other state-of-the-art contributions to mass spectrometry and DESI are set forth in commonly owned U.S. Pat. No. 8,097,845 B2 to Roach et al. that issued 17 Jan. 2012 (the "Nano-DESI Patent"), which is also hereby incorporated by reference as if set forth in its entirety herein. Indeed, "Nano-DESI" is well-known to many of those of ordinary skill in the pertinent arts. One nonlimiting process set forth in the Nano-DESI Patent is described in connection with FIG. 3 that includes: operating a sampling probe comprised of two capillary tubes; delivering solvent to the sample with one of the tubes; removing solvent containing extracted analyte; and transferring the analyte to a mass spectrometer with the other of the tubes. As a result of these and other developments, mass spectrometry has become a more viable alternative to various counterpart technologies. Even so, it should be appreciated that the subject matter of the present application potentially relates to a whole host of different technical fields.

It has been reported that some Nano-DESI systems have been used to generate a kind of two-dimensional imagery; however, such systems tend to be limited—lacking the ability to capture detailed three-dimensional (3-D) information about a sample and its compositional variation. Accordingly, the challenges involved in these and related endeavors converge to emphasize an ongoing need for further contributions to such technologies.

As a preface to the remainder of the present application, guidance follows concerning the definition of selected terminology set forth herein. Any term subject to such definition (the "subject term") may be of any type and applies to all forms as appears herein (e.g. any recognized inflection, declension, plural, singular, gerund, participle, comparative, superlative, infinitive verb (either accompanied by "to" or not), or other form resulting from affix modification with such affix functioning in its usual manner)—except to the extent stated to the contrary in writing herein. Furthermore, the definition of a subject term shall apply regardless of capitalization, font, character size, underlining, italicization, emboldening, character pitch, etc.) except to the extent stated to the contrary in writing herein. The definition of a subject term can be assigned by formal, direct statement (like a dictionary entry), or by one or more less direct approaches that ascribe partial or complete meaning to a subject term in addition to or in lieu of such direct statement (including designation of an acronym, abbreviation, neologism, or the like). Among these less direct approaches are: exemplification (relating the subject term to positive or negative examples); use of technical, engineering, or scientific equation, expression/notation/symbology to designate meaning to the subject term; explication of subject term application, usage, or scope; comparison of the subject term to certain other terminology that ascribes some degree of meaning, limitation, scope, or the like; existence/degree of mutual exclusivity with respect to certain other terminology; ranking, ordering, sequencing, or other relational grouping of terms including one or more subject terms; or use of negation language. As used herein, a definition can include any of these techniques alone or in any combination—any of which can be presented anywhere in the present application. When a subject term is initially defined, it is typically placed in single or double quotation marks, parentheses, emboldened, demarcated by a colon, or a combination of these that is accompanied by meaning-ascribing description. In other applications, a parenthetical can spell-out/expand an acronym or abbreviation that accompanies it or can enclose such acronym or abbreviation with the expanded description in close proximity thereto. Further, parentheses, single quotation marks, double quotation marks, and colons still can be used to selectively demarcate, emphasize, offset, or otherwise explain terminology or otherwise be employed as recognized in common English language grammatical/linguistic usage. While a definition routinely is provided with the first occurrence of a subject term, a definition provided anywhere herein is applicable to every occurrence of such subject term throughout the present application—including any occurrence before the definition unless expressed to the contrary in writing herein. Notwithstanding any of the foregoing, to the extent any term of the present application is repugnant (whether in whole or in part) to the usual meaning of such term, it is subject to the understanding that such term hereby adopts its usual meaning retroactively to the day the present application was filed in the United States of America. A list of certain definitions follows:

(1) For mass spectrometer analysis, "Analyte" broadly refers to both the molecular and ionized forms of a substance absent express limitation to one or the other.

(2) "Portion" broadly refers to a part, piece, constituent, or component that is separate from the whole and also to any part, piece, constituent, or component that is integral/unitary to the whole, or included/contained in the whole.

(3) "Shearing Force" or "Shear Force" collectively means: (a) unaligned forces pushing on one part of a body in one direction and another part of the body the opposite direction (in contrast, aligned opposing forces result in compression of the body instead of a shearing force); (b) the same as that described by any accepted definition of the subject terms in the fields of mechanical engineering, structural engineering, physics, or any other like field(s) in which the subject terminology is known to those of ordinary skill in such field(s); (c) the mechanical force that varies with separation distance between two objects in close proximity to one another even though the applicable mechanism(s) involved may be in dispute, unclear, or unknown; or (d) a combination of two or more of the foregoing to the extent consistent with one another.

(4) "Nano-Spray" means any material sprayed from a device that includes pieces of such material each having a minimum dimension of 1000 nanometers or less; and where such spraying results from any emission, flow, transport, movement, pressurized delivery, or the like of a liquid, powder, particulate matter, film, mist, droplet, vapor, power flow, or mixture of one or more of the foregoing.

Any definition provided herein should be understood to supplement and not supplant any other meaning or usage not otherwise specifically addressed in any fields pertinent to the present application—except to the extent expressly stated to the contrary or inconsistent therewith. What follows next is a brief summary of a few representative inventions or other contributions provided by the present application without any intention that this summary be considered exclusive or be given greater or lesser weight or importance than any others set forth elsewhere herein.

SUMMARY

Certain embodiments of the present application include unique techniques to determine selected characteristics of a sample with mass spectrometer analysis. These characteristics may include sample composition, a three-dimensional (3-D) sample representation, 3-D shape of sample surface, topography of the sample surface, a 3-D image or other visualization of spatially varying sample composition, or a combination of some or all of the foregoing—just to name a few.

Other embodiments are directed to a unique apparatus, assembly, equipment, instrumentation, mechanism, method, process, procedure, routine, system, or device that provides information representative of sample composition, a 3-D spatial configuration of the sample, sample compositional variation with 3-D shape, a visualization depicting spatial variation of sample composition over three-dimensions, or a combination of some or all of the foregoing.

Another embodiment comprises: operating sample analysis equipment including a mass spectrometer, a moveable sample stage, a sensor, and probe instrumentation; mounting a sample to the stage—the sample defining an uneven surface facing the probe instrumentation and spaced apart therefrom by a separation distance while mounted to the stage. The probe instrumentation includes an agent delivery probe defining an agent passage from an agent inlet to an agent outlet and an analyte collection probe defining an analyte passage from an analyte intake to an analyte outlet. This embodiment further includes directing energy with the equipment; detecting a response to the energy with the sensor to determine topography of the uneven surface and regulate the sample separation distance; delivering a fluid agent to the sample through the agent outlet to extract one or more analytes; collecting the one or more analytes with the analyte intake; transferring the one or more analytes through the analyte outlet to an inlet of the mass spectrometer in the form of a nano-spray or other type; and evaluating the one or more analytes with the mass spectrometer to provide information indicative of the sample composition relative to the topography. Some or all of the extracted analytes may be molecules, ions, or a combination of the foregoing.

When molecular analytes are delivered to the mass spectrometer, it includes equipment to ionize the same for performing compositional analysis. In one form of this embodiment, the directing of the energy includes applying a vibration to at least a portion of the instrumentation and the detecting of the response with the sensor corresponds to measurement of a shear force characteristic that varies with the separation distance. A further refinement includes the directing of the energy with a piezoelectric stimulator and detecting the response with a piezoelectric sensor.

Yet another embodiment includes: positioning a sample relative to certain probe instrumentation—the sample defining an irregular sample face opposite the instrumentation; determining one or more characteristics representative of shear force variation in relation to at least a portion of the instrumentation; regulating separation distance between the instrumentation and the irregular sample face in accordance with one or more sample face characteristics; generating analytes from the sample with the instrumentation; and performing an analysis of the analytes with a mass spectrometer to generate information representative of sample composition relative to topography of the irregular sample face. For this embodiment, a molecular form of analytes may be converted to ions by the mass spectrometer.

A further embodiment includes a system to evaluate a sample defining an uneven sample surface that includes: a mass spectrometer with an analyte inlet; an agent source to provide a liquid agent; a voltage source operable to provide at least 1000 volts; probe instrumentation including an agent probe in fluid communication with the agent source and an agent probe dispensing outlet and being electrically coupled to the voltage source, and an analyte collection probe in fluid communication with a analyte probe intake and the analyte inlet, the agent probe and the analyte probe being close together to form a liquid bridge therebetween when the agent is delivered to the sample with the agent probe to form analyte ions for routing to the mass spectrometer with the analyte probe; a positioning device including a sample support structure and a mechanism to selectively adjust distance between the instrumentation and the uneven sample surface when the sample engages the support structure; detection equipment to generate a sensor signal corresponding to the distance; a distance regulator responsive to the sensor signal to control the distance by generating one or more control signals with the positioning device being responsive to the control signals to regulate the distance.

In a different embodiment, analysis equipment comprises a mass spectrometer, probe instrumentation, and means for mounting a sample with an uneven surface to face the probe instrumentation and to be spaced apart therefrom by a separation distance. The probe instrumentation includes: means for directing energy to monitor the separation distance; means for detecting a response to the energy to determine topography of the uneven surface and regulate the separation distance from the instrumentation; means for delivering a fluid agent to the sample to generate one or more analytes; means for collecting the analytes; and means for transferring the analytes to an inlet of the mass spectrometer to analyze sample composition and provide information representative of the sample composition relative to the topography.

Still another embodiment comprises: an analysis system including one or more probes, a mass spectrometer, means for mounting a sample to dispose a sample face opposite the probes, means for spacing apart the sample and the probes by a sample separation distance, means for determining one or more characteristics representative of shear force variation in relation to at least a portion of at least one of the probes close to the sample face, means for regulating the sample separation distance in accordance with the one or more characteristics, and means for providing one or more analytes from the sample to the mass spectrometer to analyze sample composition and generate information representative of the sample composition relative to topography of the sample face. One form of this embodiment includes means for generating an image from the information to depict sample compositional variation with shape of the sample face.

The above introduction is not to be considered exhaustive or exclusive in nature—merely serving as a forward to further advantages, apparatus, applications, arrangements, aspects, assemblies, attributes, benefits, characterizations, circuitry, circuits, combinations, components, compositions, configurations, constituents, details, detectors, determinations, devices, discoveries, elements, embodiments, examples, experiments, explanations, expressions, factors, features, forms, formulae, implementations, innovations, kits, layouts, machinery, manufactures, materials, mechanisms, methods, modes, models, objects, options, operations, parts, practices, procedures, processes, properties, qualities, refinements, relationships, representations, sensors, structures, substitutions, synthesis, systems, techniques, traits, uses, utilities, variations, or variants that shall become apparent from the description provided herewith, from any patent claim, drawing, and/or other information included herein.

BRIEF DESCRIPTION OF THE DRAWING(S)

Throughout the present application, occurrence of a reference numeral in one figure like that in a previously introduced figure refer to a like feature already described in connection with the occurrence of such reference numeral in the previously introduced figure.

FIG. 1 is a partially diagrammatic, side view of a system for imaging topography of the uneven surface of a sample including a mass spectrometer, a controller, and sample interface equipment for defining several different sample regions for mass spectrometry evaluation as directed/managed by the controller.

FIG. 2 is a partially diagrammatic, top left perspective view of the system of FIG. 1 showing the sample in three dimensions and fluid agent delivery subsystem in greater detail. The controller and related connections are not shown to preserve clarity. FIG. 2 shows probe instrumentation in place for sample interrogation, while FIG. 1 shows this instrumentation prior to such placement.

FIG. 3 is a partially diagrammatic, side view of the system of FIGS. 1 and 2 showing the sample with readily visible unevenness of the top surface of the sample, the delivery end portion of the supply capillary conduit in greater detail, and different features of the controller not shown in FIG. 1. Relative to FIGS. 1 and 2, the mass spectrometer and a collection probe of the probe instrumentation are not shown to preserve clarity.

Figure 8:
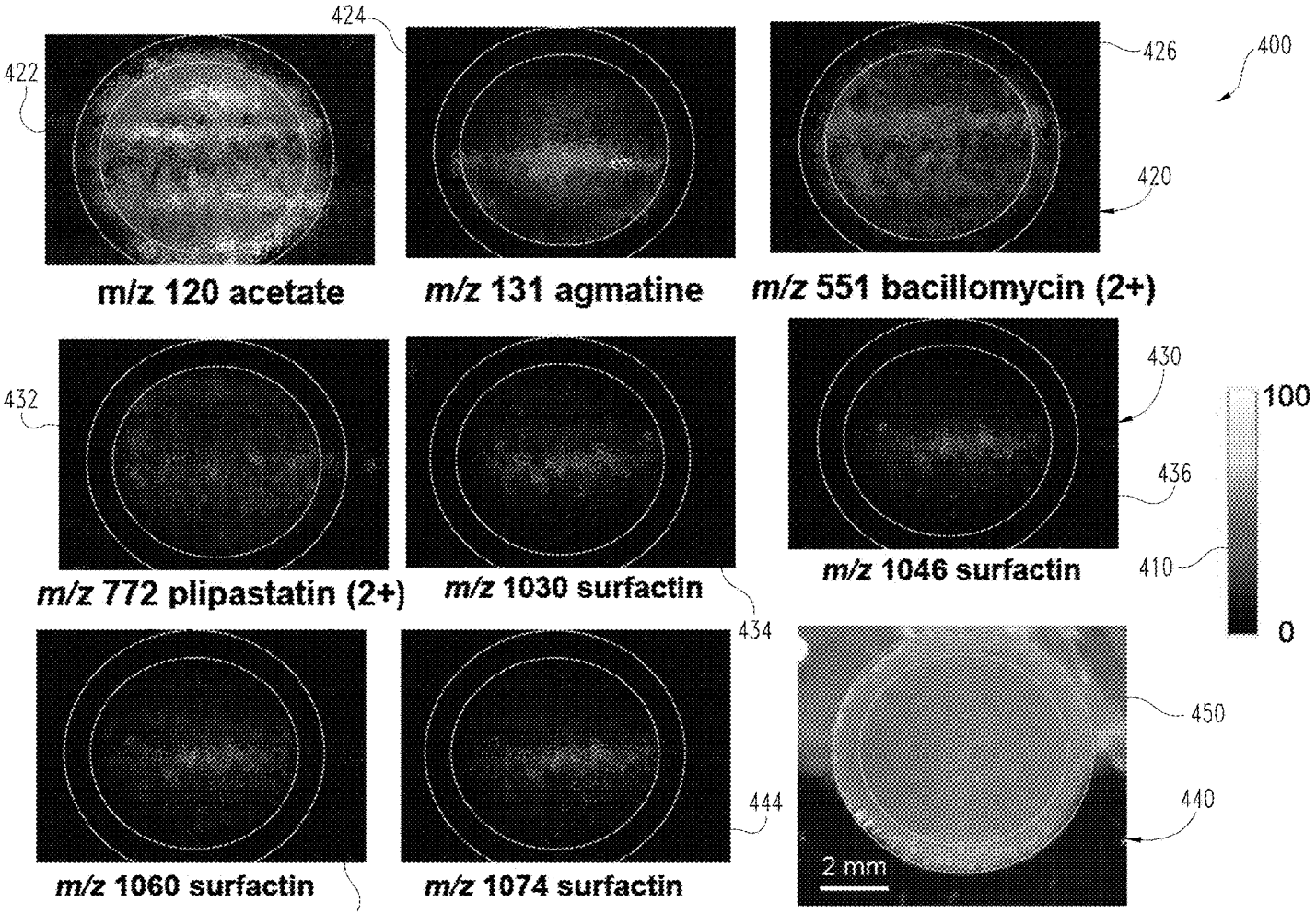

FIG. 8 is a comparative presentation of nine computer-generated grayscale views of a *B. Subtilis* colony grown on an agar nutrient medium for about twenty-four hours. The first eight views illustrate images obtained for selected mass-to-charge (m/z) species on the *B. Subtilis* colony by plotting the relative abundance of each species as a function of location on the colony subject to the key to the right mapping relative abundance, and the ninth view is of the colony under normal lighting—not being subject to the key.

Figure 9:
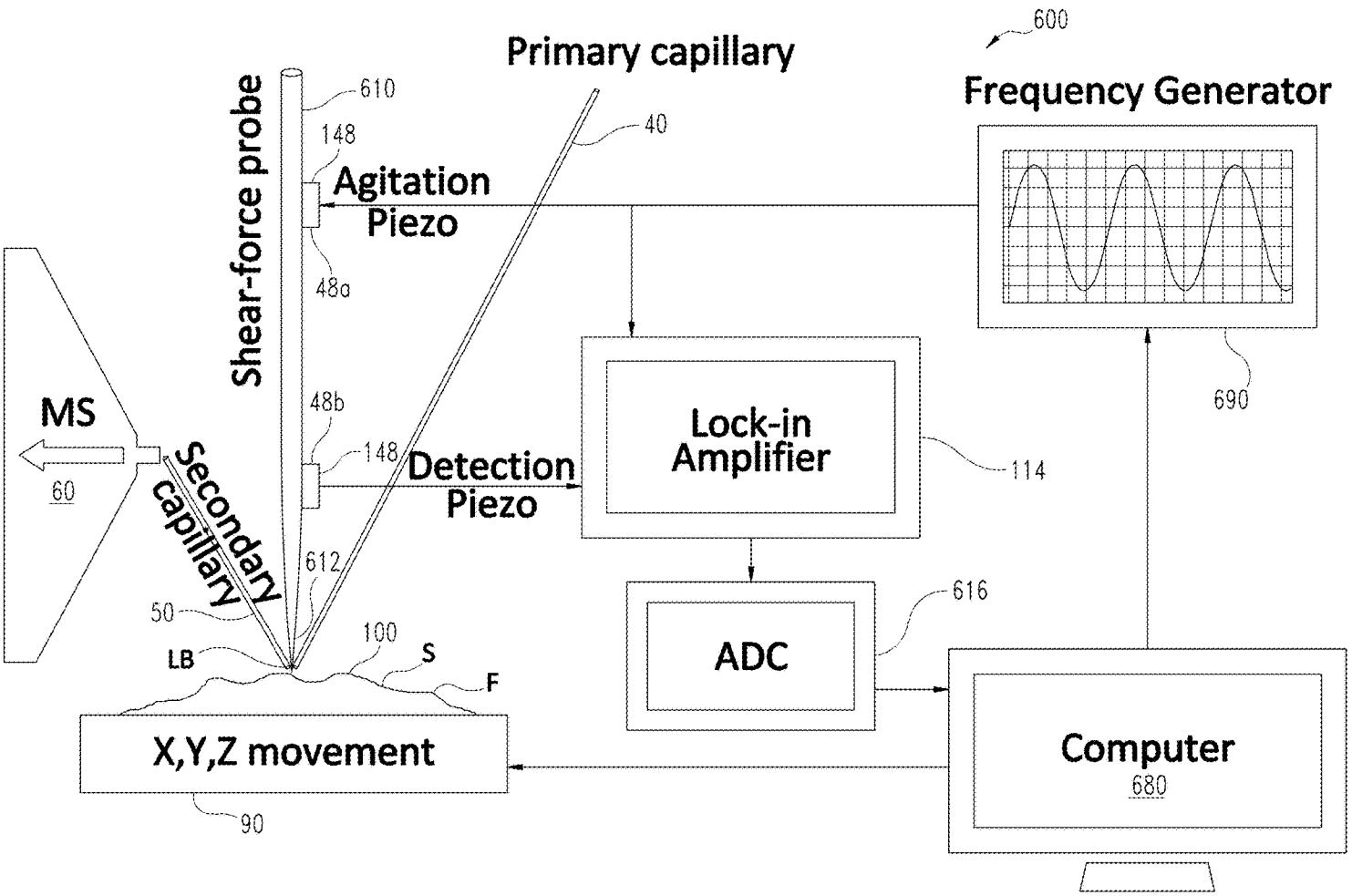

FIG. 9 illustrates an experimental system set-up of another embodiment of the present application that includes a third probe dedicated to piezoelectric shear-force distance measurement instead of configuration of the primary probe for such measurement. This third shear-force probe is positioned between the agent delivery probe (primary probe) and the analyte collection probe (secondary probe), and is generally upright with its tip very close to the solvent bridge formed between the other probes. The third probe was fabricated by attaching two piezoelectric devices to a pulled silica capillary with an Outer Diameter (OD) of about 0.8 mm and Inner Diameter (ID) of about 0.2 mm. The upper piezoelectric device was operatively connected to a waveform generator to induce tip oscillation. The lower piezoelectric device, (closer to the pulled end of the tip than the upper piezoelectric device), was controlled by a lock-in amplifier to sense tip vibration in response to stimulation by the upper piezoelectric device. The whole system was operated through a computer controlled closed feedback loop.

Figure 10:
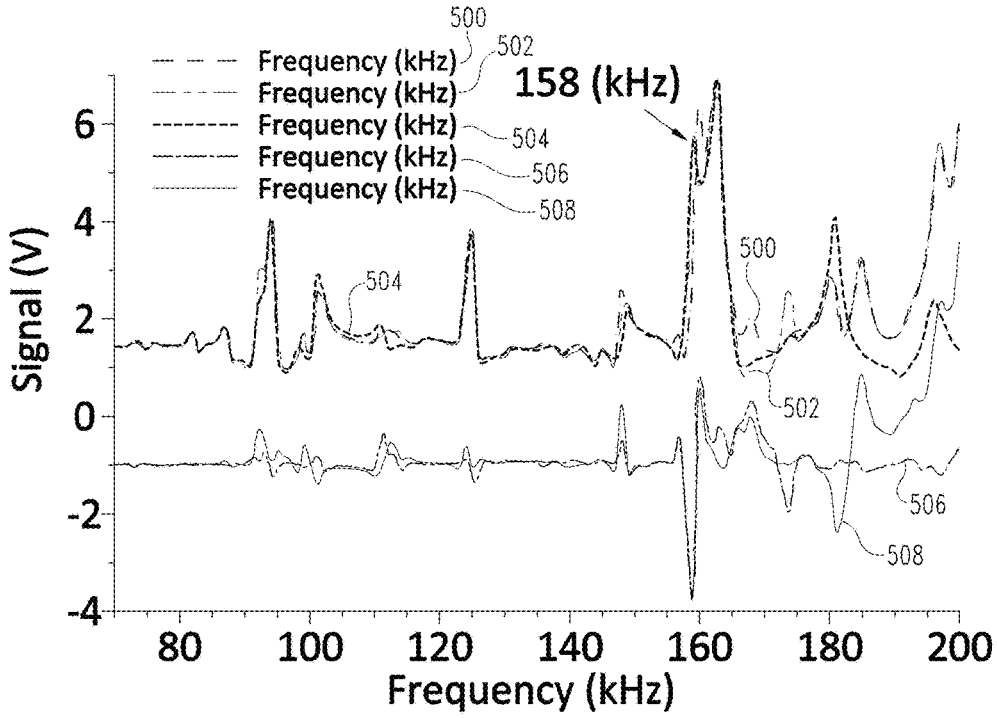

FIG. 10 depicts a frequency spectra (70-200 kHz) of a *Bacillus Subtilis* ATCC 49760 sample scanned with ~20 μm diameter shear-force probe tip as shown in the experimental embodiment FIG. 9. Signals measured with the probe kept in air (trace 500), with the tip positioned on the agar surface (trace 504) and where the tip touched the sample surface (trace 502). Trace 506 represents the signal's differences between tip in air and on agar while trace 508 shows differences between tip in air and on the sample. The arrows indicate the selected frequency for certain experiments at which the two superimposed spectra (agar vs. colony) have the same amplitude while signals from air vs. surface differ significantly from each other.

Figure 11:
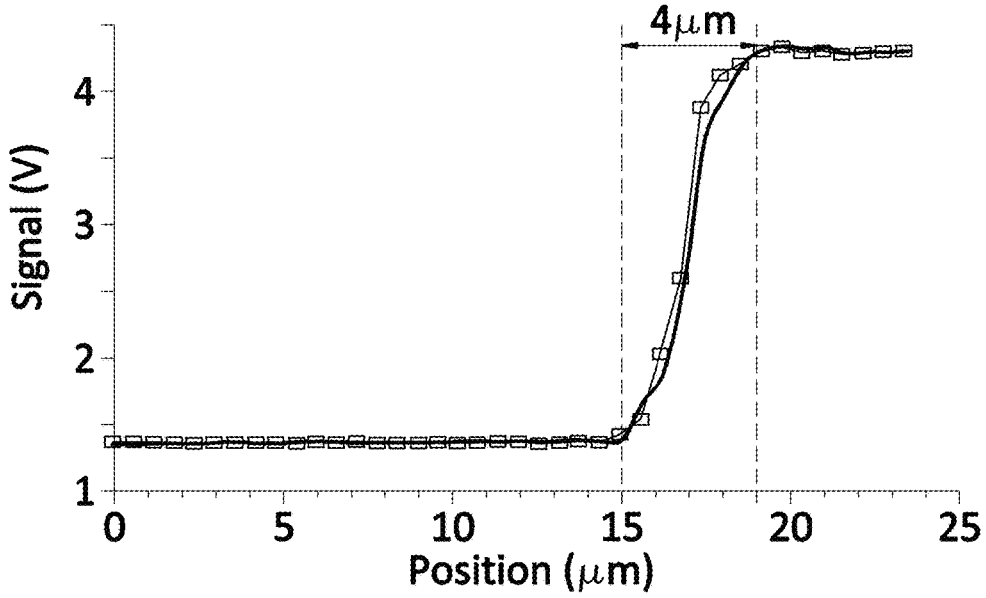

FIG. 11 shows the sharp approach curves of the shear-force tip moving from air to agar surface and to colony surface. Amplitude of the tip vibration was plotted against tip-to-sample distance.

DETAILED DESCRIPTION OF REPRESENTATIVE EMBODIMENTS

In the following description, various details are set forth to provide a thorough understanding of the principles and subject matter of each invention claimed or described herein. To promote this understanding, the description refers to certain representative embodiments—using specific language to explicate the same accompanied by any drawing(s) to the extent the description subject matter admits to illustration. In other instances, when the description subject matter is well-known, such subject matter may not be described in detail and/or may not be illustrated to avoid obscuring information to be conveyed hereby. Considering further the invention(s) defined by any claim that follows or otherwise set forth in the description, those skilled in the relevant art(s)/field(s) will recognize that such inventions can be practiced without one or more specific details included in the description. It is also recognized by those skilled in the relevant art(s)/field(s) that the full scope of any invention claimed or otherwise described herein can encompass, cover, extend to, or otherwise apply to any instance in which one or more various unexpressed aspects are present, included, practiced, incorporated, happen, occur, or otherwise exist in addition to that subject matter made explicit therein. Such unexpressed aspects can be directed to anything that is additional with respect to what is explicitly disclosed, including but not limited to at least one additional apparatus, arrangement, assembly/subassembly, circuit, component, composition, combination, configuration, constituent, device, element, feature, form, modification, machinery, material, mechanism, method, mode, operation, outcome, part, phase, piece, procedure, process, product, portion, quality, refinement, relationship, replacement, result, stage, structure, system, subsystem, technique, use, any duplication or repetition of any of the preceding unexpressed aspects, any excess quantity of an expressed aspect, or any combination of the foregoing beyond what is expressly recited in a patent claim or other invention description set forth herein. Accordingly, this description of representative embodiments should be seen as illustrative only and not limiting the scope of any invention claimed or otherwise described in the present application.

In another embodiment of the present application, probe instrumentation delivers a fluid agent to each of several regions of a sample. The sample defines an irregular surface that is uneven between one of the regions and at least one other of the regions. For each of the regions: causing one or more corresponding regional sample analytes to be extracted in response to the fluid agent; regulating the distance between the instrumentation and the uneven surface; directing the regional analytes to a mass spectrometer with the instrumentation; analyzing the regional analytes with the mass spectrometer to determine regional sample composition. This embodiment further includes providing information corresponding to a three-dimensional (3-D) representation of sample composition. In one embodiment refinement, the distance is regulated in accordance with a shear force measurement between the instrumentation and the sample. In one variation of this refinement, a piezoelectric sensor provides one or more shear force characteristics corresponding to sample separation distance measurement. In still another variation, a piezoelectric stimulator is provided to induce vibration of a portion of the distance sensor closest to the sample at a resonant frequency for detection by the piezoelectric sensor. In a further refinement, the instrumentation includes an agent supply probe to deliver the fluid agent and an analyte collection probe to direct the regional analytes to the mass spectrometer. In one variation of this further refinement, the fluid agent is a liquid and the distance is regulated to be approximately constant. Yet another form of this embodiment includes the information being representative of a topographic image of the uneven surface of the sample corresponding to the regions.

Figure 1:
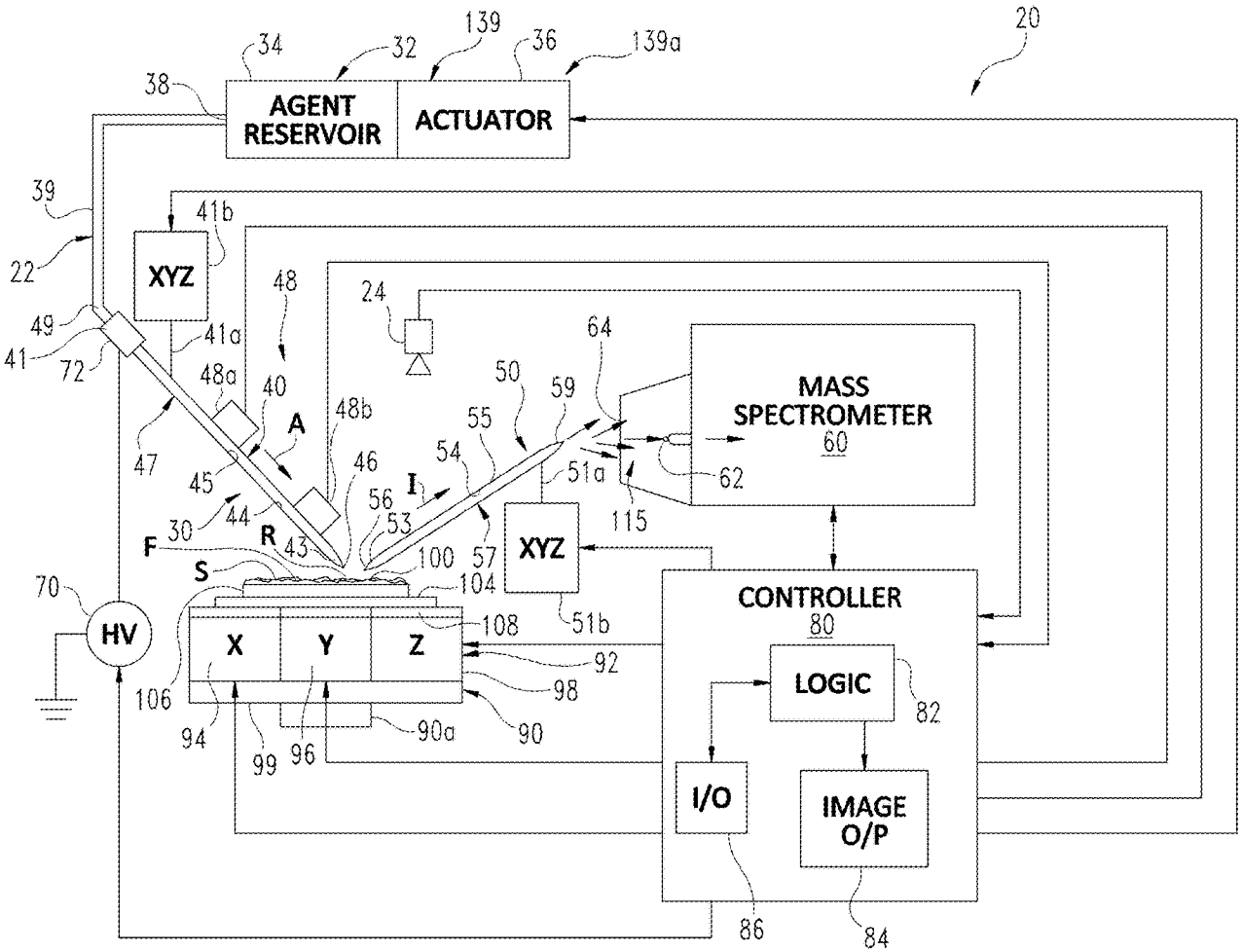
Figure 2:
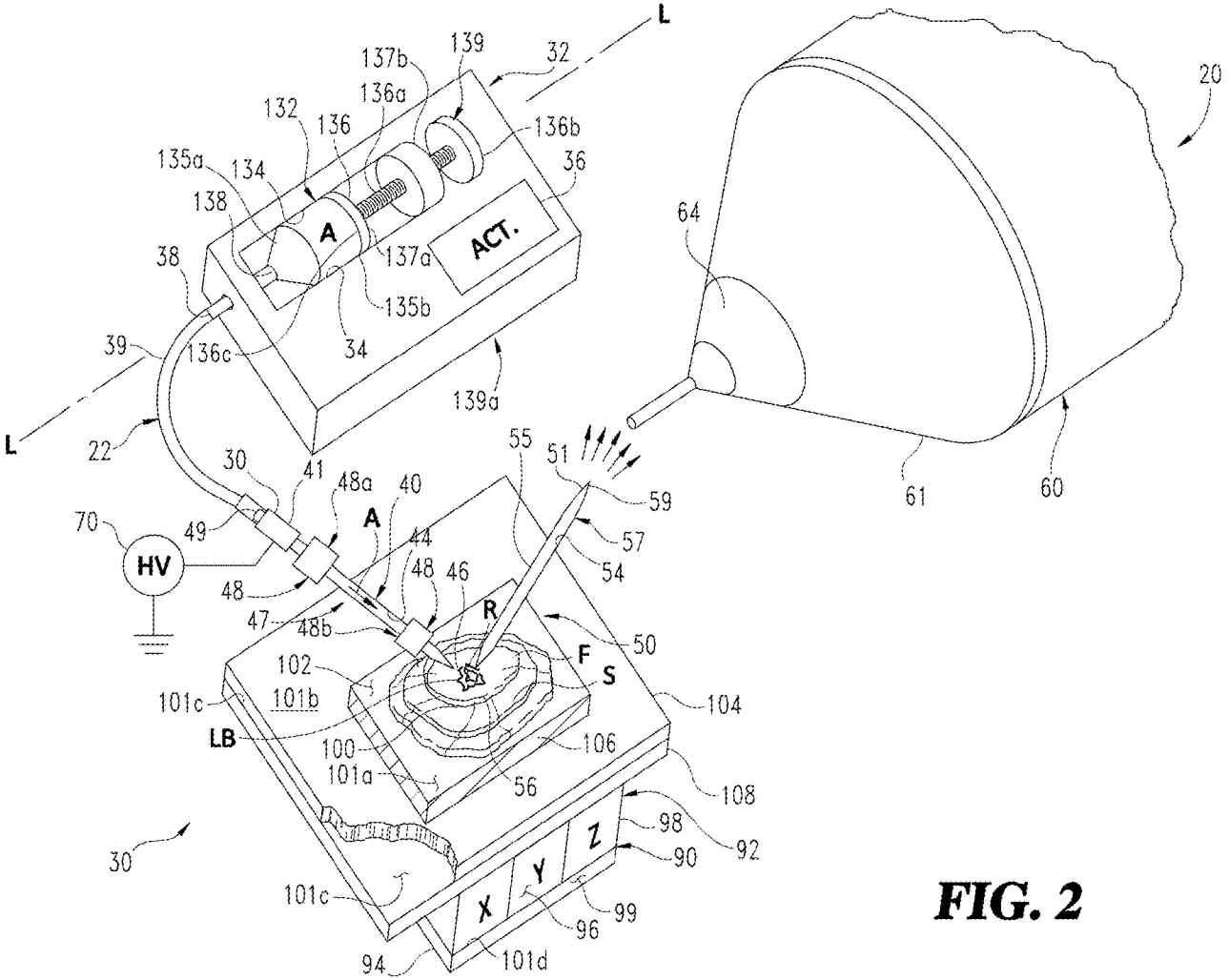
Figure 3:
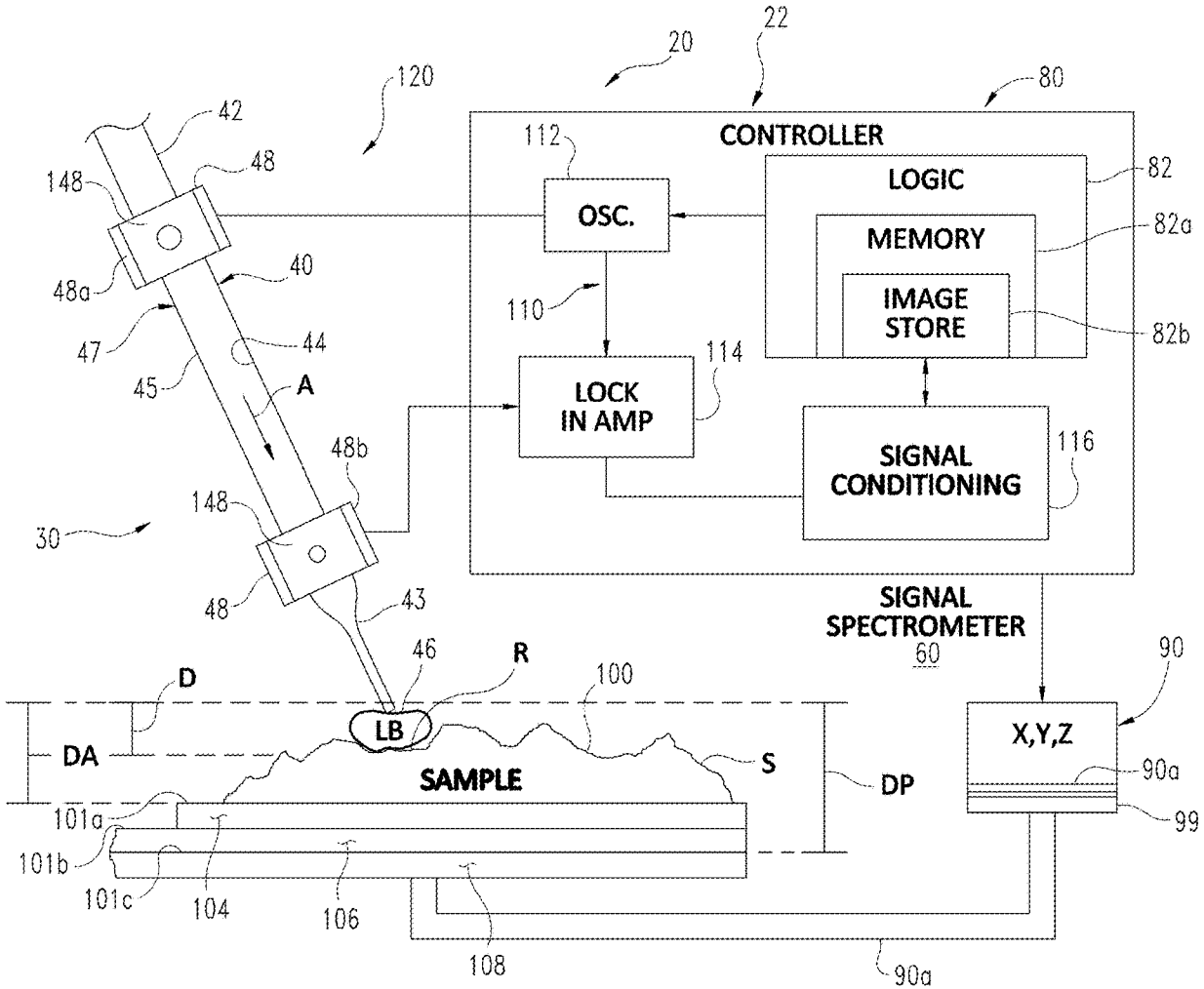

FIGS. 1-3 illustrate sample analysis system 20 of a further embodiment of the present application. Per the depiction of FIGS. 1-3, some aspects of system 20 are figure-specific while other aspects of system 20 are redundant as to two or more of these figures to enhance understanding and clarity thereof. As to such redundant aspects, like reference numerals appearing in one of these figures designate like features. System 20 includes sample interface equipment 22, mass spectrometer 60, and controller 80. For the depicted embodiment, equipment 22 receives, positions, prepares, and otherwise processes sample S for evaluation by mass spectrometer 60 one sample region R at a time, as governed by controller 80. Controller 80 also provides for the creation and storage of information corresponding to a three-dimensional (3-D) representation of sample S as determined with equipment 22 and mass spectrometer 60, and further facilitates image generation and output based on such information. By way of nonlimiting example, the topography of an uneven surface of sample S (e.g. varying sample height) can be characterized with system 20, which shall be further described hereafter; however, various aspects of sample interface equipment 22, mass spectrometer 60, and controller 80 are first described as follows.

Considering Mass Spectrometry (MS) in isolation, it should be appreciated that there are numerous subtypes and varied combinations of possible experimental configurations. Remarkable technical diversification has taken place, as echoed by the numerous MS sub-types, a few of which are listed as follows: traditional MS, tandem MS (MS/MS), single quadrupole MS, tandem quadrupole MS, Time-of-Flight (TOF) MS, ion trap MS, Ion Mobility (IMS), Fourier Transform MS (FTMS), Secondary Ion Mass Spectrometry (SIMS), static magnetic/electric field sectors for mass analysis, traveling wave (T-wave) selective ion separation, Liquid Chromotography-Mass Spectrometry (LCMS), Capillary Electrophoresis-Mass Spectrometry (CEMS), or any combination of two or more of these as limited only by the imagination. Further, a large diversity of sample preparation and ionization techniques have been developed for use with MS and new techniques are constantly emerging.

Equipment 22 of system 20 includes probe instrumentation 30, fluid agent source 32, voltage source 70, and sample stage 90. Probe instrumentation 30 includes a primary agent delivery probe 40 and a secondary analyte collection probe 50. Agent delivery probe 40 includes agent supply conduit 44 that defines agent delivery passage 45 therethrough. Passage 45 extends from agent inlet 49 at agent supply coupling 41 to agent outlet 46 defined by capillary tip 43. Analyte collection probe 50 includes analyte collection conduit 54 that defines collection passage 55 therethrough. Passage 55 extends from analyte intake 56 defined by capillary tip 53 to analyte outlet 59 defined by mass spectrometry spray tip 51 (See FIG. 2). The spray emanating from tip 51 is of a nano-spray type in one embodiment, but may vary in other embodiments. In the depicted embodiment, conduit 44 is more specifically in the form of a primary capillary tube 47, and conduit 54 is more specifically in the form of a secondary capillary tube 57 made of fused silica or another material suitable for the particular application. In various other embodiments, tube 47, tube 57, or both may be completely or partially formed as a capillary depending on the desired application, properties of the fluid agent, tube material, sample composition, and the like.

As best shown in FIG. 3, tip 43 necks-down to a diameter that exhibits capillary properties with a polar glass composition and a liquid extraction solvent form of the delivery agent, such as a methanol, ethanol, acetonitrile, mixtures of thereof with water and/or acetic acid, or the like. For the depicted embodiment, tip 53 is formed likewise; however, in other embodiments conduit 44 or 54 may be differently formed with or without necking down to a capillary tip 43 or 53, respectively.

Fluid agent source 32 includes agent reservoir 34 dispensed through outlet 38 by operation of actuator 36. Outlet 38 is connected to agent supply coupling 41 of probe 40 by supply line 39. Reservoir 34 contains fluid agent A that may be metered to probe 40 for deposit on region R of sample S. Preferably, agent A is a form of liquid. More preferably, agent A is a polar solvent. Referring specifically to FIG. 2, the depicted fluid agent source 32 is shown as a form of syringe 132 structured to meter a selected amount of fluid agent A to probe 40. Syringe 132 extends along longitudinal axis L and defines reservoir 34 as a form of volume variable chamber 134 containing agent A. Chamber 134 has a funnel-shaped, conical portion 135*a* opposite a right circular shaped cylindrical portion 135*b*. Portion 135*a* funnels down to a nozzle at tip 138 in fluid communication with outlet 38. Portion 135*b* varies in volume with the position of plunger 139. Plunger 139 includes piston 137*a* fixed to threaded shaft 136*a* that is in turn fixed to mechanical linkage 136*b* at the opposite end. Piston 137*a* engages the cylindrical wall of portion 135*b* to form a moveable seal 136 that contains agent A in variable chamber 134. Cap 137*b* is fixed to cylindrical portion 135*b* opposite conical portion 135*a* and defines threading (not shown) complimentary to that of shaft 136*a*. Accordingly, shaft 136*a* is threaded through cap 137*b*.

In operation, rotation of shaft 136*a* about axis L in one direction (clockwise or counterclockwise) advances piston 137*a* along axis L towards conical portion 135*a*, and rotation of shaft 136*a* in the opposite direction (counterclockwise or clockwise) moves piston 137*a* along axis L towards cap 137*b*. The corresponding lineal movement range of piston 137*a* along axis L extends from the engagement of piston 137*a* with conical portion 135*a* to the engagement of piston 137*a* with cap 137*b*. The volume of variable chamber 34 changes with the position of piston 137*a* along axis L, such that a maximum volume occurs when piston 137*a* and cap 137*b* meet and a minimum volume occurs when piston 137*a* and conical portion 135*a* meet. Mechanical linkage 136*b* interfaces shaft 136*a* and actuator 36. Actuator 36 and linkage 136*b* are responsive to control signals from controller 80 to provide mechanical power sufficient to direct rotation such that piston 137*a* can be controllably positioned along the indicated range as limited by engagement with conical portion 135*a* and cap 137*b*. In one particular embodiment, actuator 36 is a stepper motor with a rotational shaft carrying a toothed gear that meshes with gearing included in linkage 136*b*. In another embodiment, mechanical linkage 136*b* and a stepper motor form of actuator 36 are structured with a belt and pulley mechanism to selectively turn plunger 136. In still a further embodiment, shaft 136*a* is not threaded and instead is structured for push-pull (linear) actuation along axis L with actuator 36 and linkage 136*b*. In a further embodiment, syringe 132 is of a type structured for manual use (not shown) in lieu of or in addition to that controlled with controller 80 and actuator 36. It should be recognized that syringe 132 is a variety of pump 139*a* that pressurizes fluid (agent A) in chamber 134 in response to movement of piston 137*a* (positive pressure generation from pushing plunger 136) and generates suction in response to movement of piston 137*a* towards cap 137*b* (negative pressure generation from pulling plunger 136). Accordingly, in other embodiments, fluid agent source 32 can be any suitable form of pump or different device/mechanism (such as a gravity-fed arrangement) that adequately pressurizes the agent A for dispensing via probe 40. It should be appreciated that any such source 32 can be structured for continuous pressurization and supply of agent A to probe 40, intermittent pressurization and supply of agent A to probe 40 on a periodic or aperiodic basis, or a combination of both.

Referring specifically to FIG. 1, instrumentation 30 is depicted prior to operational placement of probe 40 and probe 50 relative to region R of sample S. Instrumentation 30 includes three-dimensional (3-D) XYZ positioning mechanisms 41*b* and 51*b* mechanically fixed to probes 40 and 50 by schematically illustrated linkages 41*a* and 51*a*, respectively. Mechanisms 41*b* and 51*b* are operatively coupled to Input/Output (I/O) 86 of controller 80 and are each responsive to control signals therefrom to position probes 40 and 50 relative to each other—especially spacing between probe tips 43 and 53. Camera 24 is also coupled to I/O 86 of controller 80 with an image zoom or enlargement capability to display probe tips 43 and 53 to an operator at a size sufficient to aid with proper positioning thereof via mechanisms 41*b* and 51*b*, respectively.

Referring generally again to FIGS. 1-3, movable XYZ sample stage 90 includes positioning mechanisms 92 (Z), 94 (X), and 96 (Y) that can be adjusted in each of three mutually perpendicular directions. Mechanisms 92, 94, and 96 are each operatively connected to controller 80 to be responsive to control signals from I/O 86 to independently control position of stage 90 in each of these three mutually perpendicular directions over a corresponding range of movement. Stage 90 has base 99, and mechanisms 92, 94, and 96 each move relative to base 99 in the respective direction. Base 99 is connected to a mounting surface (not shown) by mounting 90*a*.

Stage 90 further includes sample mounting platform 108. In the depicted illustration, sample S is fixed to carrier 104 that may be in the form of a slide, culture dish, or other type suitable for mounting to stage 90 and carrying sample S. A bacterial growth medium 106 in the form of agar or other suitable type extends along the upper surface of carrier 104 opposite mounting platform 108. Carrier 104, medium 106, and platform 108 each include a generally planar upper surface 101*c*, 101*b*, and 101*a*, respectively (as perhaps best shown in FIGS. 2 and 3). For the depicted system 20, sample S is grown on medium 106, and defines a face F with an uneven or irregular sample surface 100 due to varying height of face F; where height corresponds to the vertical direction that is perpendicular to the direction of consecutive letters and reference numerals shown in the side views of FIGS. 1 and 3. Face F of sample S is positioned opposite probes 40 and 50 of instrumentation 30.

In response to control signals Output (O/P) by I/O 86 of controller 80, mechanisms 92, 94, and 96 of stage 90 is capable to changing the specific portion of sample S corresponding to region R located between probe tips 43 and 53 along an XY plane parallel to the planar surfaces 101*a*, 101*b*, and 101*c* previously described, and to vary the distance separating sample surface 100 from probe tips 43 and 53 in the Z direction parallel to the vertical/height direction already described in connection with FIGS. 1 and 3, It should be appreciated that the XY plane extends horizontally relative to the vertical/height direction previously described and is perpendicular to the view plane of FIGS. 1 and 3 in parallel with the horizontal direction of consecutive lettering and reference numerals in FIGS. 1 and 3. While pump 139*a*, mechanisms 41*b* and 51*b*, and camera 24 are shown to be integrally operable with controller 80 via I/O 86 connectivity, one or more of these may be independently controlled and/or manually adjusted and utilized (not shown). Like any one or more of mechanisms 41*b*, 51*b*, and camera 24; stage 90 may be controlled by a controller separate from or independent of controller 80, and/or manually controlled (not shown).

Returning to reservoir 34, agent A flows therefrom in response to actuation with actuator 36 or manually. From reservoir 34 agent A enters probe 40 through agent inlet 49 and travels through agent delivery passage 44 to agent outlet 46 defined by tip 43 and into contact with sample S. Once probes 40 and 50 and sample S carried by stage 90 are all suitably positioned, a liquid form of agent A forms a liquid bridge LB between tips 43 and 53 in region R. For a suitable form of liquid agent A, one or more desired types of analyte are extracted or liberated from sample S. Analyte intake 56 defined by tip 53 collects analyte(s) for transfer through analyte passage 54 and out of analyte outlet 59 in the form of nano-spray or other very fine spray 64. Spray 64 enters mass spectrometer inlet 62 for compositional analysis. Extracted analytes may be in the form of molecules, ions, or a combination of both depending on the chemistry and other circumstances of the arrangement. To the extent molecular, the mass spectrometer 60 is equipped to convert the analyte molecules to ions suitable for mass spectrometer compositional analysis.

Probe 40 is electrically connected to a High Voltage (HV) voltage supply 70 that is controllable with an O/P signal from I/O 86 of controller 80 and of a sufficient value and polarity relative to electrical ground to provide a desired electric field bias. In one embodiment, the voltage is at least 1000 volts.

A shear force sample separation distance detection subsystem 48 is also connected to probe 40. Subsystem 48 includes a mechanical stimulator 48*a* to direct mechanical energy in the form of a resonant vibration to probe 40 based on a corresponding O/P signal from I/O 86 of controller 80. Subsystem 48 further includes a vibration sensor 48*b* to detect a vibratory response of probe 40 and deliver a corresponding UP signal to I/O 86 of controller 80. Referring specifically to FIG. 3, stimulator 48*a* and sensor 48*b* are both a piezoelectric device maintain in fixed mechanical contact with probe 40, with stimulator 48*a* being located farther away from tip 43 than sensor 48*b*. In other embodiments of subsystem 48, a different type of stimulator, sensor, or both may be utilized.

It has been discovered that shear force acting between two structures varies with the distance separating such structures that is particularly meaningful to keep the structures separated but still be very close together. Subsystem 48 is structured to determine relative separation distance of the sample from probe tip 43 based on shear force variation. Still referring to FIG. 3, Controller 80 further includes logic 82 that performs various operations of controller 80 is in the form of programming, hardware, firmware, or a combination of these. Logic 82 includes memory 82*a* which in turn includes an image store 82*b* to record information representing a three-dimensional image of sample S, topography of surface 100, or the like as is further described hereinafter. Memory 82*a* may be of a semiconductor, optic, magnetic, electromagnetic, volatile, or nonvolatile type; or the like, or a combination of any of these. Controller 80 may further include one or more network connections or other communication pathways of a wireless or hardwired type, or a combination of any of these.

Also, controller 80 has operational constituents directed to detecting characteristics representing shear force variation between tip 43 and surface 100 of sample S. Specifically, controller 80 defines oscillator (OSC.) 112 to generate a time-varying signal that is directed external to controller 80 as an O/P and internally, too. Oscillator 112 may be of a fixed or variable type in terms of waveform shape, frequency, amplitude, a combination of these, or the like. Oscillator 112 provides an O/P signal to stimulate stimulator 48*a* at a fixed or adjustable frequency—directing mechanical energy for sample distance determination purposes generally imparting a corresponding vibration to probe 40. Typically, the oscillator 112 O/P signal is tuned to a resonant frequency. Controller 80 also includes Lock-In Amplifier (AMP.) 114. Lock-in amplifier 114 has two inputs, one is internal signal 110 from oscillator 112 that is the same as that constituting the driving O/P signal for stimulator 48*a* and the other being the UP signal from sensor 48*b*. Lock-in amplifier 114 includes hardware and/or software to compare the two input signals and generate an internal output that represents any difference between the two inputs. The lock-in amplifier 114 output is typically in the form of a relatively constant level compared to the time-varying frequency output by oscillator 112 or sensor 48*b*. Controller 80 includes signal conditioning 116 to put the lock-in amplifier 114 output in a proper form to input to logic 82. Typically, signal conditioning 116 includes an analog-to-digital (A/D) converter or the like. The shear force characteristic represented by lock-in amplifier 114 O/P to signal conditioning 116 may be a difference in resonant vibration amplitude (magnitude), a shift in resonant frequency, a change in phase, a change in resonance quality (Q) factor, a combination of these, or the like.

Controller 80 may be comprised of analog hardware, digital hardware, or a combination of these in addition to any programming or the like comprising logic 82. Furthermore, controller 80 may be configured as a single, integral unit, or comprised of two or more independent units with or without separate, independent control over various aspects of system 20. For instance, controller 80 may be a governing processor that controls operatively connected to controller 80 as Input (UP), O/P, or I/O signals. Controller 80 may further serve as the controlling device for mass spectrometer 60 or may be separate therefrom with or without interconnection for control purposes. Indeed, in other embodiments (not shown) mass spectrometer 60 is controlled independent of other aspects of system 20.

Figure 4:
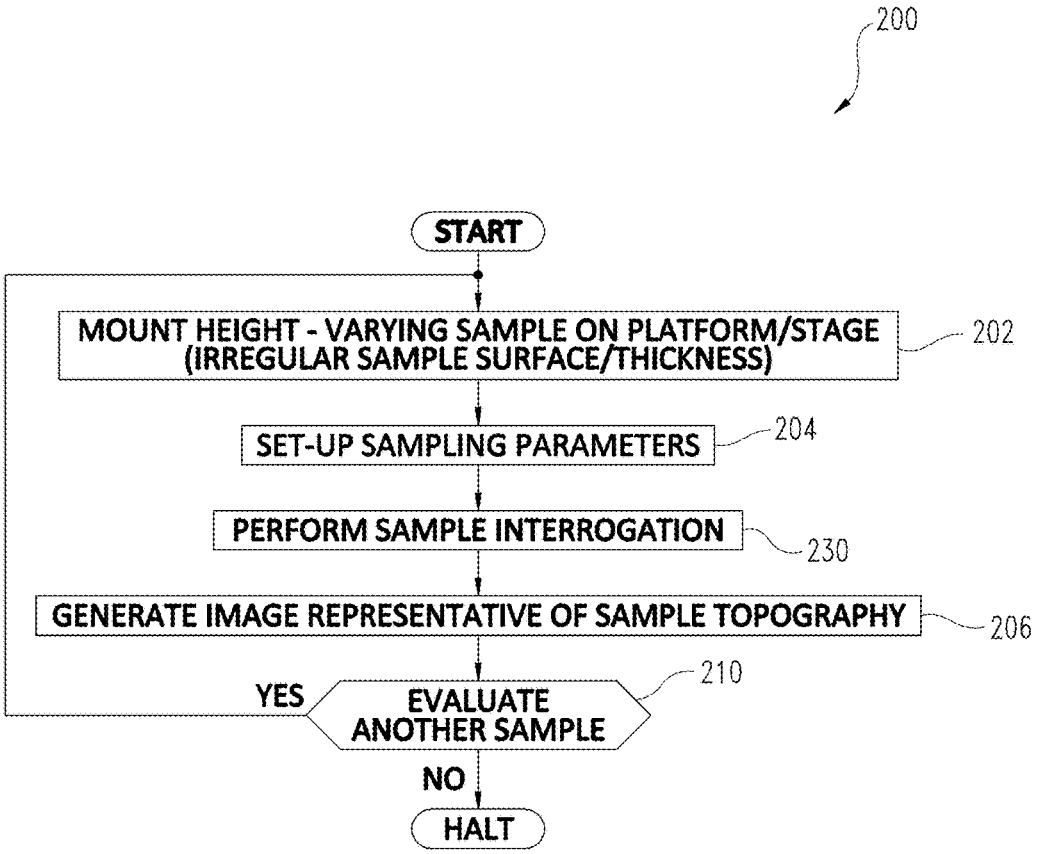
FIG. 4 is a flowchart of a sample MS imaging procedure performed using the system of FIGS. 1-3. The procedure of FIG. 4 calls a sample region interrogation routine detailed in FIG. 5.

Referring additionally to the flowchart of FIG. 4, sample evaluation procedure 200 is next described. Procedure 200 can be implemented with system 20 of FIGS. 1-3, among others, demonstrating selected operational aspects thereof. Typically, operations and conditionals are performed directed by logic 82 of controller 80 unless executed manually or otherwise taking place external to controller 80. Procedure 200 starts with operation 202. In operation 202, sample S is prepared, including any preparation for sample, placement/growth on carrier 104, etc. In one embodiment, sample S is a form of *B. Subtillis* colony grown on an appropriate growth media 106 (such as agar) in a petri dish form of carrier 104 as shown in image 440 of comparative computer generated images 400 of FIG. 8 (lower right-hand corner). Growth media 106 defines a relatively regular, even surface 101*a*. Likewise, carrier 104 has a relatively even surface 101*b*. However, it should be appreciated that in some embodiments, little or no sample preparation is required. After preparation during operation 202 (if any), sample carrier 104 is mounted on a platform 108 of moveable stage 90 previously described to complete operation 202 and positioned as depicted in FIGS. 1-3. It should be recognized that sample S has an irregular face F (uneven sample surface 100).

From operation 202, procedure 200 continues with operation 204. In operation 204, instrumentation 30 is set-up to evaluate the mounted sample S. For the embodiment of procedure 200, the agent A is liquid agent. Correspondingly, the set-up includes positioning probes 40 and 50 with respective stages 41*b* and 51*b* to place agent probe tip 46*a* and analyte probe tip 56*a* in close proximity to each other to facilitate formation of agent liquid bridge LB therebetween. When properly formed for operation 204, liquid bridge LB contacts probe 40, probe 50, and uneven surface 100 of face F. The formation of liquid bridge LB involves the relative separation between agent probe tip 46*a* and analyte probe tip 56*a*, the angle of each probe 40 and 50 relative to the sample S, the distance D separating each tip 46*a* and 56*a* from sample S (as best shown in FIG. 3), the rate of liquid agent flow, whether agent flow is continuous or intermittent, and the composition of the agent liquid and the sample region R—to name a few. Further parametric adjustments include positioning of sample S as carried by stage 90 for analysis at multiple regions R with user-defined spacing between them along face F. The regions R correspond to planar coordinates X and Y along face F. This positioning includes placement of sample S at the beginning region R, as represented by coordinate X=0, of the first scan line along face F, as represented by coordinate Y=0. To provide three-dimensional (3-D) information about the topography of uneven sample surface 100, a third coordinate Z is set as further explained hereinafter. Still other parameters set in operation 204 include the application of controller 80 to set the absolute voltage level of source 70 and the temperature and voltage set with respect to inlet 62 of mass spectrometer 60.

Once the pertinent parameters are set via operation 204, sample interrogation of the current sample region R takes place in sample interrogation routine 230. Referring to the flowchart of FIG. 5, routine 230 of procedure 200 is further described that can be implemented according to logic 82 of controller 80. Routine 230 begins with initiating a coordinate counter to the first line of Y=0 in operation 232 and initiating the coordinate counter to the first region X=0 of line Y=0 in operation 234. From operation 234, routine 230 proceeds to height determination routine 260.

Figure 6:
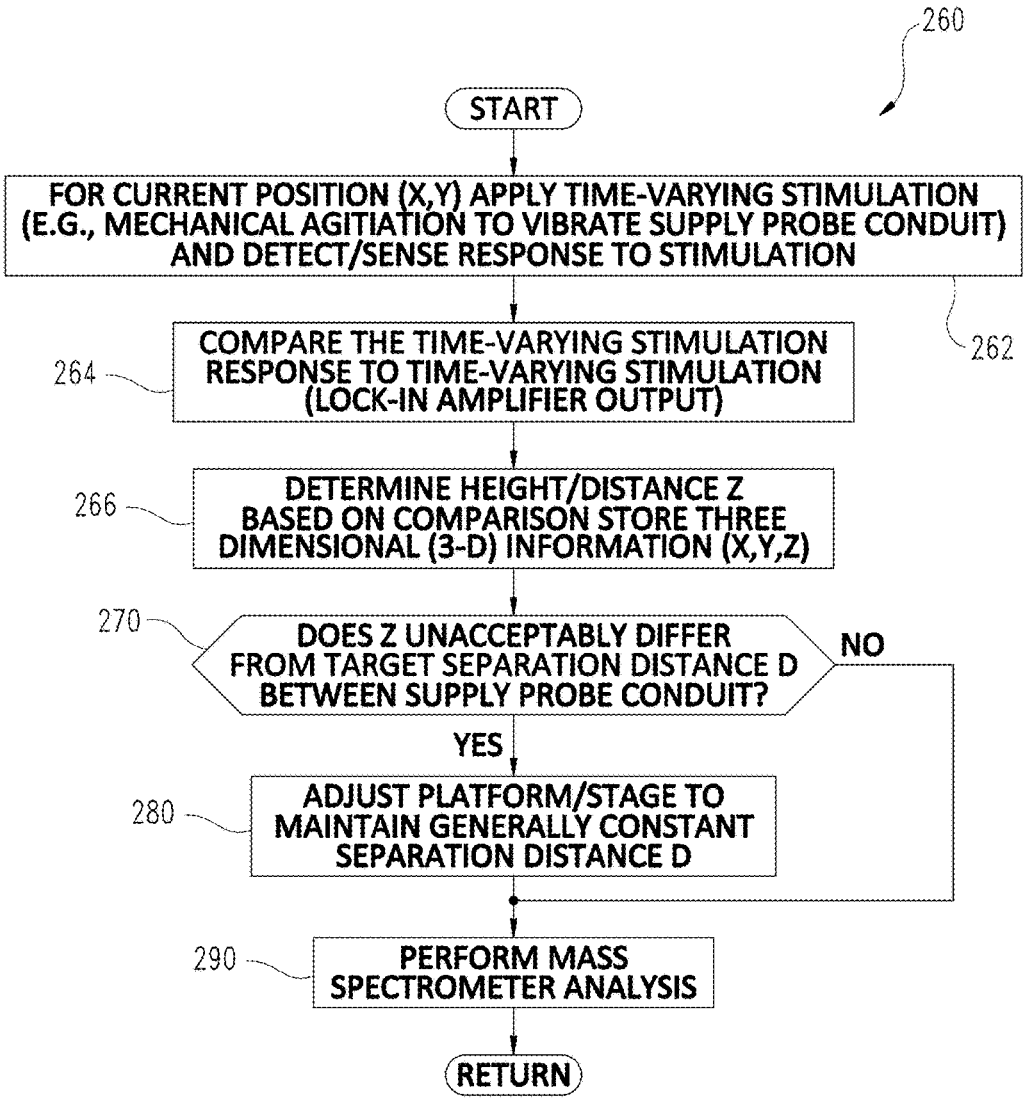
FIG. 6 is a flowchart of the sample region height determination routine as called by the routine of FIG. 5 and performed with the system of FIGS. 1-3.

Turning to the flowchart of FIG. 6, routine 260 is further described. Routine 260 begins with operation 262. In operation 262, for the given region R designated by the current {X,Y} coordinate set, detection equipment 47 is activated. During activation of equipment 47, energy in the form of a mechanical vibration is directed to probe 40 with stimulator 48*a* and the vibratory response of probe 40 closer to tip 46*a* is sensed with sensor 48*b*. This mechanical vibration is performed with oscillator (osc.) 112 of controller 80 (see FIG. 3). Oscillator 112 provides a time-varying signal, the frequency of which is set with controller 80. This frequency is applied to stimulator 48*a* to correspondingly target a resonant vibration of probe 40. The response detected with sensor 48*b* varies with distance D between agent probe tip 46*a* and uneven surface 100 of sample S (see FIG. 23). Stimulator 48*a* and sensor 48*b* are both in the form of a piezoelectric device 48 that converts between mechanical and electrical forms of energy, The vibration variation detected with sensor 48*b* relative to that applied with stimulator 48*a* (and correspondingly output by oscillator 112) may be in terms of vibration magnitude (amplitude), vibration phase shift relative to the target frequency produced with oscillator 112, change in resonant frequency of probe 40, change in resonant quality factor Q, or a combination of two or more of these. This variation is commonly attributed to the observation that shear force changes as two objects approach one another—even before forming direct contact therebetween. Accordingly, the vibratory variation detected with sensor 48*b* in response to stimulator 48*b* is a measure of shear force variation with distance D separating agent probe tip 46*a* from surface 100.

Routine 260 continues with operation 264. In operation 264, signal applied to oscillator 112 is also delivered to lock-in amplifier 114 of controller 80 to serve as a time-varying reference for an input from sensor 48*b*. For the depicted embodiment (FIG. 3), the output of lock-in amplifier 114 is an analog signal direct current (DC) signal that corresponds to this vibratory response level of sensor 48*b* relative to the oscillator 112 input. Accordingly, in operation 264 lock-in amplifier 114 provides a way to compare an alternating current (AC) oscillator 112 signal input representative of the vibration caused by stimulator 48*a* with the AC signal input representative of the vibratory response detected with sensor 48*b*.

From operation 264, routine 260 proceeds to operation 266 in which the output of lock-in amplifier 114 is conditioned by signal conditioning circuitry 116—including format conversion from an analog type of signal to a digital type of signal (Analog-to-Digital Converter (ADC). The resulting digital signal is applied to controller logic 82 to determine the relative separation distance D between agent probe tip 46*a* and sample face F. For this determination, the uneven surface 100 corresponds to a relative variation in height thereof. This relative height variation can be based normalized to the topographical extremes of uneven surface 100 accounting for all regions R of sample S. Alternatively or additionally, this height variation may be determined relative to an approximately constant surface height level, such as the approximately uniform height of growth medium 101*a* (see DA in FIG. 3), carrier surface 101*b* (not specifically designated in the figures), stage platform surface 101*c* (see DP in FIG. 3), base 99 (not specifically designated in the figures), or the like. Such height determination may be in absolute units, normalized units, etc. The resulting height value assigned to the current X, Y region {X,Y} is assigned as coordinate Z and the 3-D coordinate values for X, Y, and Z {X,Y,Z} are stored in memory 82*a* of logic 82 for the current sample region R under interrogation.

With continued reference to FIG. 6, routine 260 next performs conditional 270 using the height information determined in operation 266. Conditional 270 tests whether the separation distance between agent probe tip 46*a* and face F is unacceptable per separation distance regulation imposed by controller 80. If the test of conditional 270 is affirmative (Yes), then separation distance is unacceptable, and control of routine 260 proceeds to operation 280. In operation 280, controller generates one or more stage control signals output to stage 90. Stage 90 is responsive to these signals to adjust stage 90 to change its relative height and correspondingly change the height of sample S according to the control laws of logic 82. As depicted in FIG. 6, controller 80 (including logic 82 and regulator 110) maintains an approximately constant separation distance between tip 46*a* and uneven surface 100 of sample S. Nonetheless, in other embodiments, a different control law, logic 82, and regulator 110 can be utilized as would be known to those of ordinary skill in the fields to which the subject matter of the present application relate.

From operation 280, operation 290 is performed. Operation 290 performs mass spectrometry analysis of ionized analytes from along the current region of sample face F with mass spectrometer 60. This analysis produces compositional information for the current region R of uneven surface 100 that is stored along with the topography information stored in operation 266. From operation 290, routine 260 returns to the calling routine 230 of procedure 200. In contrast, if the test of conditional 270 is negative (No), then operation 280 is bypassed and routine 260 returns to routine 230 directly from conditional 270. This negative result of the conditional 270 test leaves the current separation distance between tip 46*a* and surface 100 of sample S the same without adjustment of stage 90 to change height.

Figure 5:
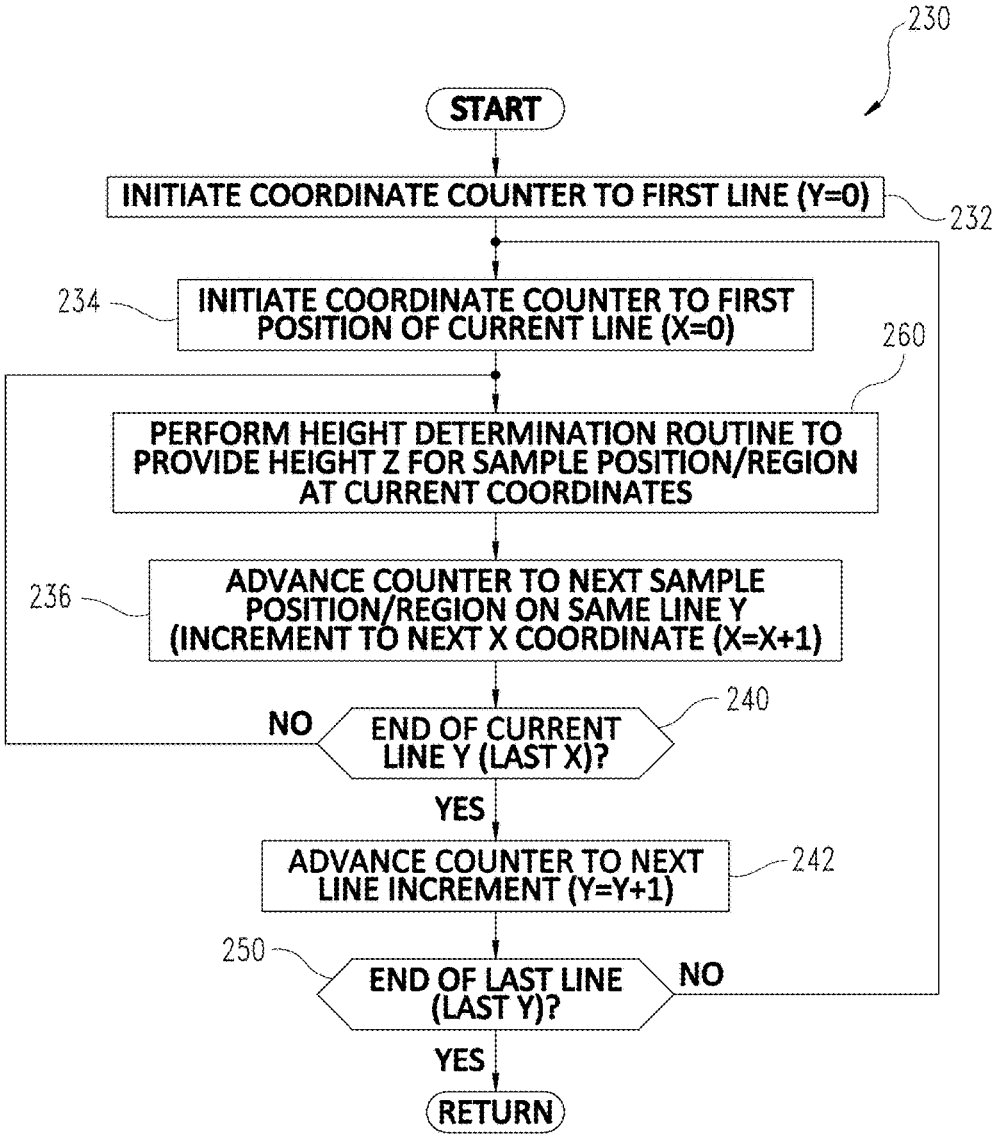
FIG. 5 is a flowchart of the sample region interrogation routine as called by the procedure of FIG. 4 and performed using the system of FIGS. 1-3. The routine of FIG. 5 calls a sample region height determination routine detailed in FIG. 6.

Referring back to the flowchart of FIG. 5, once routine 260 is performed, control returns to operation 236 of routine 230. Given the completion of routine 260 for the current {X,Y} region R along face F of sample S, the coordinate counter for the interline (same Y) value of X is incremented in operation 236. In other words, coordinate X is incremented (X=X+1) to the next region R of sample S within the current line Y. Routine 230 next proceeds to conditional 240. Conditional 240 tests whether X exceeds the end of the current line Y. If the test of conditional 240 is negative (No), then routine 230 continues by looping back and repeating performance of routine 260 followed by operation 236 to again increment X. This loop (routine 260-operation 236-conditional 240) continues until the end-of-line Y is reach, such that the test of conditional 240 is affirmative (Yes). With the conditional 240 test being affirmative, routine 230 then continues with operation 242. In operation 242 the coordinate counter Y is incremented to the next line (Y=Y+1). From operation 242, conditional 250 is next encountered. Conditional 250 tests whether the last region R (end of last line) has been processed. If the test of conditional 250 is negative (No), then routine 230 loops back to operation 234 to repeat initiation of the interline region R position, as represented by coordinate X, to zero (X=0) and then re-enters the nested loop (routine 260-operation 236-conditional 240), repeating it until the end of the next line is reached as tested by conditional 240. Operation 242 and conditional 250 are then repeated, advancing line-by-line with each increment of coordinate counter Y. Once the last line has been reached and all the regions R along it, then the test of conditional 250 is affirmative (Yes) and routine 230 is halted and returns.

Upon return from routine 230, procedure 200 continues with operation 206. In operation 206, an image representative of the topography of the uneven surface 100 (irregular face F) of sample S is generated that includes variation in sample S composition along with this topography. Controller includes image Output (O/P) device 84 that may be in the form of a pixelated digital display, a printer, or both. Information corresponding to the 3-D sample information determined by shear force measurements, regulation, or otherwise is stored in image store 82*b* of memory 82*a* of logic 82 of controller 80.

Figure 7:
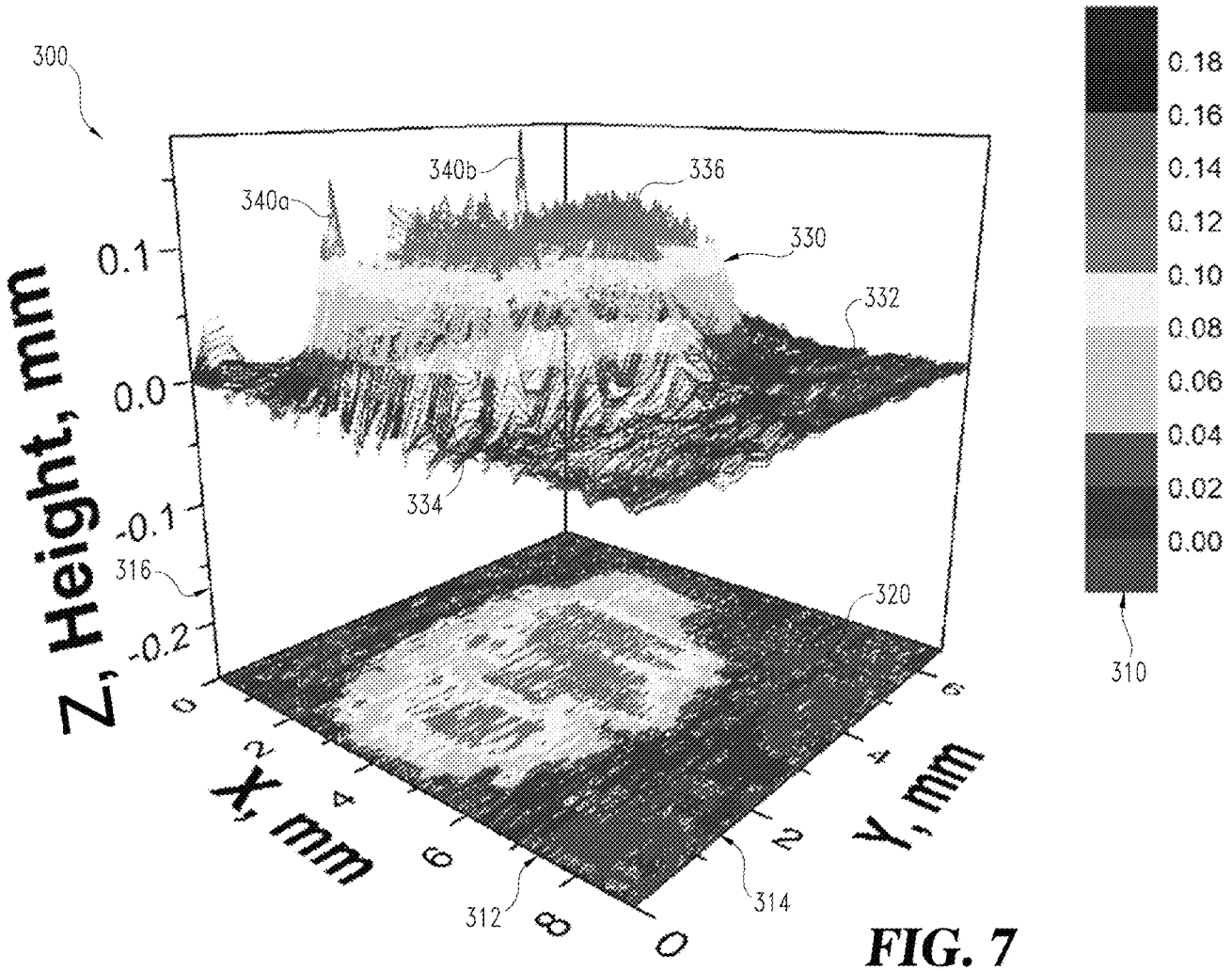
FIG. 7 is a computer-generated, grayscale image with a key representing three dimensional (3-D) information about a colony of *Bacillus subtilis* ATCC 49760 (*B. Subtilis*) as obtained by interrogation of multiple sample regions with the system of FIGS. 1-3 operated in accordance with the procedure of FIG. 4 (inclusive of the routines of FIGS. 5 and 6).

This information is selectively displayed with device 84 from store 82*b* to depict a three-dimensional visualization of the sample S, one example of which is illustrated in computer-generated grayscale form in FIG. 7. More specifically, FIG. 7 provides a computer-generated 3-D topographic image 300 with grayscale representation of sample composition variation depicting three dimensional (3-D) information about a colony of *Bacillus subtilis* ATCC 49760 (*B. Subtilis*) as experimentally obtained by interrogation of multiple sample regions with system 20 of FIGS. 1-3 operated in accordance with the procedure 200 of FIG. 4 (inclusive of the routines of FIGS. 5 and 6). The X, Y, and Z axes are shown in millimeters and designated by reference numerals 312, 314, and 316, respectively. A two-dimensional base X-Y planar representation 320 is shown corresponding to the collective compositional variation of the sample S designated in 3-D by reference numeral 330. This 3-D sample topography 332 includes several designated peaks 340*a*, 340*b*, and 336 with the grayscale shading assigned in accordance with the scale 310 to the right-hand side of the image.

FIG. 8 is a comparative presentation 420 of nine computer-generated grayscale views 422, 424, 426, 432, 434, 436, 442, 444, and 450 of a *B. Subtilis* colony grown on an agar nutrient medium for about twenty-four hours. The first eight views 422, 424, 426, 432, 434, 436, 442, 444, illustrate computer-generated grayscale images obtained for selected mass-to-charge (m/z) species on the *B. Subtilis* colony by plotting the relative abundance of each species as a function of location on the colony subject to the key to the right mapping relative abundance, and the ninth view 450 is of the colony under normal lighting—not being subject to the key.

FIG. 9 relates to experimental setup of system 600 of another embodiment of the present application that includes a third probe 610 dedicated to piezoelectric shear-force distance measurement instead of configuration of the primary probe 40 for such measurement as illustrated in FIGS. 1-3. Probe 610 is dedicated to shear force sample separation distance measurement and regulation and includes stimulator 48*a* and sensor 48*b*, the tip of which is positioned between probes 40 and 50 in system 600. In FIG. 9, frequency generator 690 and computer 680 correspond to oscillator 112 and controller 80, respectively, with the functionality previously described therefor in connection with FIGS. 1-6. This third shear-force probe 610 is positioned between the agent delivery probe (primary probe) 40 and the analyte collection probe (secondary probe) 50, and is generally upright with tip 612 very close to the solvent bridge formed between the other probes 40 and 50. The information depicted in FIG. 7, FIG. 8, or both may be obtained with system 600 as an alternative to system 20 of FIGS. 1-3.

The third probe 610 of system 600 includes two piezoelectric devices 148 attached thereto. Probe 610 is in the form of a pulled silica capillary with an Outer Diameter (OD) of about 0.8 mm and Inner Diameter (ID) of about 0.2 mm. The upper piezoelectric device 148 was operatively connected to a waveform generator to induce tip 612 oscillation. The lower piezoelectric device 148, (closer to the pulled end of the tip 612 than the upper piezoelectric device), was controlled by a lock-in amplifier to sense tip vibration in response to stimulation by the upper piezoelectric device. The whole system was operated through a computer controlled closed feedback loop.

FIG. 10 depicts a frequency spectra (70-200 kHz) of a *Bacillus Subtilis* ATCC 49760 sample scanned with ~20 μm diameter shear-force probe tip as shown in the experimental embodiment FIG. 9. Signals measured with the probe kept in air (trace 500), with the tip positioned on the agar surface (trace 504) and where the tip touched the sample surface (trace 502). Trace 506 represents the signal's differences between tip in air and on agar while trace 508 shows differences between tip in air and on the sample. The arrows indicate the selected frequency for certain experiments at which the two superimposed spectra (agar vs. colony) have the same amplitude while signals from air vs. surface differ significantly from each other.

FIG. 11 shows the sharp approach curves of the shear-force tip moving from air to agar surface and to colony surface. Amplitude of the tip vibration was plotted against tip-to-sample distance.

Many different embodiments of the present application are envisioned. In some examples, other means of gathering 3-D information about sample S are utilized such as those based on light energy as opposed to directing mechanical energy. For instance, confocal and/or reflected light measurements may be used as alternatives or in combination with shear force characterization.

In a further example, another embodiment comprises: operating sample interface equipment with a mass spectrometer, the equipment including a moveable sample stage, a distance sensor, and a sampling probe, the instrumentation including an agent delivery probe defining an agent passage from an agent intake to an agent probe outlet and an analyte collection probe defining an analyte passage from an analyte probe intake to an analyte probe outlet; engaging a sample to the stage to place the sample opposite the instrumentation, the sample defining an uneven surface facing the instrumentation and spaced apart therefrom by a separation distance during the engaging; directing energy with the equipment to monitor the separation distance; detecting a response to the energy with the sensor to determine topography of the uneven surface and regulate separation distance from the instrumentation; delivering a fluid agent to the sample through the agent outlet to form one or more corresponding analyte ions; collecting the analyte ions with the analyte intake to move through the analyte probe to an inlet of the mass spectrometer; and analyzing the extracted species with the mass spectrometer to provide information indicative of the sample composition relative to the topography.

In yet another example, a further embodiment combines the features of the immediately preceding embodiment to be inclusive of: partitioning the sample into 16 or more regions each corresponding to a unique position; executing the delivering of the agent and the collecting of the analyte ions for each of the regions; executing the analysis with the mass spectrometer for each of the regions; and storing results of the analysis for the unique position of each of the regions.

Alternatively, still another embodiment includes combining the previously-identified features with: dividing a two-dimensional projection of the irregular sample face on a plane to uniquely define each of at least 64 regions in terms of a first coordinate and a second coordinate, the regions being approximately equally spaced-apart from one another, and for each one of the regions: determining a third coordinate based on the separation distance of the one of the regions to provide a three-coordinate set for the one of the regions unique in relation to any other of the regions, the three-coordinate set representing the topography of the uneven surface in three dimensions at the one of the regions; performing the delivering of the agent to the one of the regions; performing the collecting of the analyte ions therefrom; and performing the analysis of the analyte ions with the mass spectrometer. This embodiment may be optionally refined by including: for all of the regions, storing the results of the analysis performed with the mass spectrometer to provide a three-dimensional topographical representation of the sample; and generating an image from the three-dimensional topographical representation of the sample. Alternatively or additionally, still other possible refinements include: the stage containing a mechanism to move the sample and support together along each of three different ranges; the sample comprising a carrier, a nutrient medium layer extending over at least a portion of the carrier, and a microbe colony on the nutrient medium layer, the microbe colony defining the uneven surface opposite where the microbe colony and the nutrient medium layer meet; the fluid agent being a form of liquid solvent; the analyte ions from the analyte probe discharging into the inlet of the mass spectrometer as a nano-spray; applying at least a 2000 volts absolute magnitude to the agent probe relative to one or more of the sample, the mechanism, and the mass spectrometer; and the equipment including three actuators coupled to the mechanism, each of the actuators displacing the sample along a respective one of the three different ranges.

In other exemplary embodiments, the previously-identified features may be combined with: generating a three dimensional image of the sample from the information including topography of the irregular sample face; applying a voltage to the agent probe with an absolute magnitude of at least 1000 volts relative to one or more of the sample, the stage, and the mass spectrometer; executing the adjusting with a mechanism of the stage structured to position the support relative to three different ranges each corresponding to a different constrained direction of freedom of movement; providing a liquid form of the fluid agent and at least partially covering the sample with a liquid before executing any of the directing, the detecting, the determining, the adjusting, the routing, or the performing; or a combination of two or more of the foregoing.

In further examples, various embodiments include the previously-identified features combined with: providing a liquid agent to the agent probe, the agent probe and the collection probe being in close proximity to one another above the uneven surface, the agent probe including a capillary agent probe tip defining the agent outlet, the collection probe including a capillary analyte probe tip defining the analyte intake, and including: forming a liquid bridge from liquid agent spanning from the agent outlet to the analyte intake, the liquid bridge being in contact with the uneven surface, the capillary agent tip, and the capillary analyte tip; performing the directing of the energy by mechanically stimulating a resonant vibration of the agent probe; performing the detecting of the response with a sensor operable to detect vibration of the agent probe; determining whether to change the distance in accordance with shear force variation of the agent tip, quantifying the change to the distance as a function of one or more of the following: (a) magnitude of the shear force relative to a vibration resonance; (b) a phase shift relative to the resonant vibration; (c) a resonant frequency shift relative to the resonant vibration; or (d) a change in resonance quality factor; or a combination of two or more of the foregoing.

Yet a further embodiment comprises a system to evaluate a sample defining an uneven sample surface, comprising: a mass spectrometer; an agent source to provide a liquid agent; a voltage source operable to provide at least 1000 volts; an agent delivery probe electrically coupled to the voltage source, the agent probe defining an agent passage therethrough in fluid communication with the agent source and a dispensing outlet through an agent probe tip; probe instrumentation including an agent probe in fluid communication with the agent source and an agent probe dispensing outlet and being electrically coupled to the voltage source, and an analyte collection probe in fluid communication with a analyte probe intake and the analyte inlet, the agent probe and the analyte probe being close together to form a liquid bridge therebetween when the agent is delivered to the sample with the agent probe to form analyte ions for routing to the mass spectrometer with the analyte probe; a positioning device including a sample support structure and a mechanism to selectively adjust distance between the instrumentation and the uneven sample surface when the sample engages the support structure; detection equipment including a vibration stimulator to stimulate vibration of at least a portion of the instrumentation and a vibration sensor to generate a sensor signal corresponding to vibratory movement of the portion of the instrumentation; and a controller including a regulator responsive to the sensor signal to determine an instrumentation separation distance in correspondence to shear force variation of the portion of the instrumentation relative to the uneven sample surface when the sample engages the sample support structure to move therewith and generate one or more position control signals, the positioning device being responsive to the position control signals to regulate the instrumentation separation difference.

Any patent, patent application, or non-patent publication cited in the present application is hereby incorporated by reference as though the same was set forth in its entirety herein—except to the extent expressly stated to the contrary. In no case is any content of the present application (including any definitions set-forth herein) intended to be understood as being repugnant to the usual meaning (if any) of such content. Any experimentation, testing, test result, theory, thesis, hypothesis, idealization, mechanism, normalization, estimate, example, model, proof, belief, speculation, conjecture, guess, guesswork, discovery, investigation, finding, simplification, or other like information is provided to enhance comprehension of the present application without imposing any limitation or restriction of any invention claimed or otherwise described herein—except to the extent expressly recited otherwise therewith. Any advantage, apparatus, application, assembly, arrangement, aspect, attribute, benefit, characterization, combination, component, composition, compound, condition, configuration, constituent, design, detail, determination, device, discovery, embodiment, example, exchange, experiment, explanation, expression, factor, feature, form, formula, gain, image, implementation, innovation, kit, layout, machinery, material, mechanism, method, mode, model, object, option, operation, part, process, procedure, property, quality, refinement, relationship, representation, routine, species, structure, substitution, system, technique, trait, use, utility, variation, variant, or the like that come within the spirit, scope, or meaning of any invention claimed or otherwise intended so to be are desired to be protected. Also, the description of the present application may include the term "embodiment" or synonymous terminology. Any embodiments of the present application set forth herein are representative only. Two embodiments of the present application differ if at least one express aspect differs between them. A reference to an embodiment herein need only explicitly include association with a given aspect once, where such association may be implicit for any other reference to the same embodiment. Moreover, express description of an aspect of one embodiment may, but need not be, associated with any other embodiment unless expressly described to be so. The content of the present application may be organized under one or more different headings to promote readability, form, or organization thereof or comply with imposed requirements regarding the same. Each of these headings (including the terms thereof) is understood to have no effect as to the scope, meaning, substance, or "prior art" status of any language stated thereunder, except to the extent accompanying language unambiguously expresses the contrary. The presence, absence, alteration, or repetition of information (either in whole or in part), under one heading relative to that under another heading, is not intended imply, indicate, or otherwise impose any effect absent unambiguously stating a specific exception. The terminology: especially, particularly, extraordinary, favor, favored, favorable, favorite, important, imperative, critical, crucial, considerable, marked, momentous, paramount, principal, significant, substantial, special, specialty, vitality, prefer, preferred, preferable, and preference (regardless of usage in any recognized lexical form, such as: adjective, adverb, noun, verb, comparative, superlative, gerund, or participle form thereof to the extent the same exists); or other wording synonymous to any of the foregoing, may be used to indicate an embodiment, form, feature, invention, innovation, contribution, or aspect is desirable. While such terminology may indicate variation in the degree of desirability of an embodiment, form, feature, invention, innovation, contribution, or aspect set forth herein; or establish a desired ranking or order of the same; the content of any invention claimed or otherwise described herein only includes such variation in desirability or desired ranking or order, to the extent it unambiguously recites the same. Further, this terminology does not designate such embodiment, form, feature, invention, innovation, contribution, or aspect is the only desirable one or the most desirable one unless accompanied by language to unambiguously state the same.

No claim hereof should be understood to include a "means for" or "step for" performing a specified function ("means plus function clause" or "step plus function clause") unless signaled by expressly reciting "means for . . . ," "step for . . . ," or "steps for . . . " before description of this function in the same patent clause. While no comprehensive discussion of various ways to classify patent claims is hereby intended, some distinguishing aspects pertinent to any claims provided herewith are briefly considered to enhance understanding of the intended claim construction. For avoidance of doubt, a claim is presumed to be of the open type unless the transition from the claim preamble to the claim body includes consist, consists, or consisting. Any clause or element in the claim body is presumed to be of the open type unless it includes consist, consists, or consisting.

Absent an unambiguous indication to the contrary, method or process claim elements, features, clauses, or other aspects in the claim body may be performed in any order or sequence, and any two or more of the same may be performed concurrently or overlapping one another in time. The same is not limited because of: (a) recitation in the claim of one element, feature, or other aspect before another, (b) designation of one occurrence of an element, feature, or other aspect with an indefinite article or no (zero) article with one or more subsequent occurrences being accompanied by a definite article, or (c) the claim includes alphabetical, cardinal number, or roman numeral labeling to improve readability, organization, or the like without any express statement such labeling intends to impose a particular order. In contrast, to the extent there is an intention to limit a method or process claim to a particular order or sequence of performance: (a) ordinal numbers (1st, 2nd, 3rd, etc.) or corresponding words (first, second, third, etc.) shall be expressly used to specify the intended order/sequence of corresponding method claim elements, features, or other aspects; and/or (b) when an earlier listed feature is referenced by a later listed feature and a relationship between them is of such a type that imposes a relative order because a result of the performance or happening of the first occurring element is necessary for operability of the claimed invention, a different order increases claim ambiguity, the claim language establishes a scheduling/timing relationship inconsistent with a proposed order of performing/happening of the claim elements, a specifically applicable claim construction principle supports an order of the earlier before the later, or a combination of two or more of the foregoing. However, to the extent order is imposed as to two or more elements, features, or other aspects; the same does not impose an order as to any different elements, features, or other aspects listed before, after, or between them.

Only representative embodiments have been described, such that: advantages, apparatus, applications, arrangements, aspects, attributes, benefits, characterizations, combinations, components, compositions, compounds, conditions, configurations, constituents, designs, details, determinations, devices, discoveries, elements, embodiments, examples, exchanges, experiments, explanations, expressions, factors, features, forms, formulae, gains, implementations, innovations, kits, layouts, machinery, materials, mechanisms, methods, modes, models, objects, options, operations, parts, processes, properties, qualities, refinements, relationships, representations, species, structures, substitutions, systems, techniques, traits, uses, utilities, and/or variations that come within the spirit, scope, and/or meaning of any inventions defined and/or described herein, including any claims that follow, are desired to be protected.

What is claimed is:

1. A method, comprising:

operating sample interface equipment with a mass spectrometer, the equipment including a moveable sample stage, a sensor, and probe instrumentation, the probe instrumentation including an agent delivery probe defining an agent passage from an agent intake to an agent outlet and an analyte collection probe defining an analyte passage from an analyte intake to an analyte outlet;

mounting a sample to the stage, the sample defining an uneven surface facing the instrumentation and spaced apart therefrom by a separation distance during the engaging;

directing energy with the equipment to monitor the separation distance;

detecting a response to the energy with the sensor to determine topography of the uneven surface and regulate separation distance from the instrumentation;

delivering a fluid agent to the sample through the agent outlet to generate one or more analytes;

collecting the one or more analytes with the analyte intake to transfer the one or more analytes through the analyte probe to an inlet of the mass spectrometer; and analyzing the one or more analytes with the mass spectrometer to provide information indicative of the sample composition relative to the topography.

2. The method of claim 1, which includes:

partitioning the sample into 16 or more regions each corresponding to a unique position;

executing the delivering of the agent and the collecting of the one or more analytes for each of the regions;

executing the analysis with the mass spectrometer for each of the regions; and storing results of the analysis for the unique position of each of the regions.

3. The method of claim 1, which includes:

dividing a two-dimensional projection of the irregular sample face on a plane to uniquely define each of at least 64 regions in terms of a first coordinate and a second coordinate, the regions being approximately equally spaced-apart from one another, and for each one of the regions:

determining a third coordinate based on the separation distance of the one of the regions to provide a three-coordinate set for the one of the regions unique in relation to any other of the regions, the three-coordinate set representing the topography of the uneven surface in three dimensions at the one of the regions;

performing the delivering of the agent to the one of the regions;

performing the collecting of the one or more analytes therefrom; and performing the analysis of the one or more analytes with the mass spectrometer.

4. The method of claim 3, which includes:

for all of the regions, storing the results of the analysis performed with the mass spectrometer to provide a three-dimensional topographical representation of the sample; and generating an image from the three-dimensional topographical representation of the sample.

5. The method of claim 3, which includes:

the regions numbering at least 264;

the stage containing a mechanism to move the sample and support together along each of three different ranges;

the sample comprising a carrier, a nutrient medium layer extending over at least a portion of the carrier, and a microbe colony on the nutrient medium layer, the microbe colony defining the uneven surface opposite where the microbe colony and the nutrient medium layer meet;

the fluid agent being a form of liquid solvent;

the analyte ions from the analyte probe discharging into the inlet of the mass spectrometer;

applying at least a 1000 volts absolute magnitude to the agent probe relative to one or more of the sample, the mechanism, and the mass spectrometer; and the equipment including three actuators coupled to the mechanism, each of the actuators displacing the sample along a respective one of the three different ranges.

6. The method of claim 1, which includes:

generating a three dimensional image of the sample from the information including topography of the irregular sample face, the one or more analytes including one or more molecules; and with the analyte probe, the collecting the one or more analytes including transferring the one or more analyte molecules to an inlet of the mass spectrometer; and ionizing at least a portion of the one or more analyte molecules after the collecting in accordance with an electrical bias at the inlet[N].

7. The method of claim 1, including:

applying a voltage to the agent probe with an absolute magnitude of at least 1000 volts relative to one or more of the sample, the stage, and the mass spectrometer;

executing the adjusting with a mechanism of the stage structured to position the support relative to three different ranges each corresponding to a different constrained direction of freedom of movement; and providing a liquid form of the fluid agent.

8. The method of claim 1, which includes at least partially covering the sample with a liquid before executing any of the directing, the detecting, the determining, the adjusting, the routing, or the performing.

9. The method of claim 1, in which the agent is a liquid, the agent probe and the collection probe are in close proximity to one another above the uneven surface, the agent probe includes a capillary agent probe tip defining the agent outlet, the collection probe includes a capillary analyte probe tip defining the analyte intake, and including:

forming a liquid bridge from liquid agent spanning from the agent outlet to the analyte intake, the liquid bridge being in contact with the uneven surface, the capillary agent tip, and the capillary analyte tip;

performing the directing of the energy by mechanically stimulating a resonant vibration of the agent probe;

performing the detecting of the response with a sensor operable to detect vibration of the agent probe; and determining whether to change the distance in accordance with shear force variation of the agent tip.

10. The method of claim 9, which includes relative to the resonant vibration, quantifying the change to the distance as a function of one or more of the following: (a) magnitude of the shear force relative to a vibration resonance; (b) a phase shift relative to the resonant vibration; (c) a resonant frequency shift relative to the resonant vibration; and (d) a change in resonance quality factor.

11. A method, comprising:

disposing probe instrumentation relative to a sample, the sample defining an irregular sample face opposite the instrumentation;

determining one or more characteristics representative of shear force variation in relation to at least a portion of the instrumentation close to the irregular sample face;

regulating separation distance between the instrumentation and the irregular sample face in accordance with the one or more characteristics;

generating ionized analytes from the sample with the instrumentation; and performing an evaluation of the ionized analytes with the mass spectrometer to generate information representative of sample composition relative to topography of the irregular sample face.

12. The method of claim 11, including:

the probe instrumentation being comprised of: a liquid agent source, an agent delivery probe in fluid communication with the source, an analyte collection probe in fluid communication with the mass spectrometer;

with the agent probe, delivering the liquid agent from the source to the irregular sample face to form the ionized analytes along the irregular sample face; and with the analyte probe, directing the ionized analytes from the irregular sample face to the mass spectrometer.

13. The method of claim 12, which comprises:

partitioning the irregular sample face into 64 or more regions each corresponding to a unique position therealong;

for each of the regions, performing the delivering of the liquid agent, the directing of the ionized analytes, the determining of the one or more characteristics, the regulating of the separation distance, and the generating of the ionized analytes; and storing the information for the unique position of each of the regions.

14. The method of claim 11, in which the determining of the one or more characteristics includes:

stimulating vibration of at least a portion of the instrumentation;

sensing a vibratory response to the stimulating of the vibration;

providing the one or more characteristics in accordance with the vibratory response, the one or more characteristics corresponding to one or more of: (a) magnitude of the shear force; (b) a phase shift relative to frequency of the vibratory response; (c) a resonant frequency shift; and (d) a change in resonance quality factor.

15. The method of claim 14, which includes:

partitioning the irregular sample face into 64 or more regions each corresponding to a unique position therealong;

for each of the regions, performing the delivering of the liquid agent, the directing of the ionized analytes, the determining of the one or more characteristics, the regulating of the separation distance, and the generating of the ionized analytes; and storing the information for the unique position of each of the regions.

16. The method of claim 15, which includes preparing a three dimensional image representative of the topography.

17. The method of claim 11, which includes preparing a three dimensional image representative of the topography.

18. The method of claim 11, in which:

the determining of the one or more characteristics includes:

stimulating vibration of at least a portion of the instrumentation in response to a time-varying output signal of an oscillator; and detecting a vibratory response to the stimulating of the vibration with a sensor and a lock-in amplifier operatively coupled to the sensor and the oscillator.

19. The method of claim 18 which includes;

the portion of the instrumentation comprising a probe;

providing a first piezoelectric device responsive to the time-varying output signal of the oscillator and mechanically coupled to the probe to perform the stimulating of the vibration;

providing the sensor in the form of a second piezoelectric device mechanically coupled to the probe to perform the detecting of the vibratory response; and providing the one or more characteristics in accordance with the vibratory response.

20. The method of claim 11, which includes:

providing the instrumentation with a liquid agent source, an agent delivery probe in fluid communication with the source, a voltage source, and an analyte collection probe in fluid communication with an inlet of the mass spectrometer;

implementing the agent probe with an electrical coupling to the voltage source to provide the agent probe at an electric potential with an absolute magnitude of at least 1000 volts relative to at least one of the sample and the analyte probe;

the generating of the ionized analytes being inclusive of:

delivering a liquid agent from the source to a region of the irregular sample face with the agent probe to perform the generating of the ionized analytes at least in part; and forming a liquid bridge between the agent probe and the analyte probe from the liquid agent delivered to the region, the liquid bridge contacting the region of the sample, the agent probe, and the analyte probe;

collecting the ionized analytes with the analyte probe to provide a nano-spray of the ionized analytes to the inlet of the mass spectrometer;

placing the sample on a platform of a stage movable in any of three independent directions over three corresponding movement ranges, the three independent directions corresponding to three different degrees of freedom of movement each constrained by the different one of the movement ranges; and the regulating of the separation distance being inclusive of maintaining the separation distance at an approximately constant amount as position of the agent probe relative to the irregular sample face changes.

21. A system to evaluate a sample defining an uneven sample surface, comprising:

a mass spectrometer;

an agent source to provide a liquid agent;

a voltage source operable to provide at least 1000 volts;

an agent delivery probe electrically coupled to the voltage source, the agent probe defining an agent passage therethrough in fluid communication with the agent source and a dispensing outlet through an agent probe tip;

probe instrumentation including an agent probe in fluid communication with the agent source and an agent probe dispensing outlet and being electrically coupled to the voltage source, and an analyte collection probe in fluid communication with a analyte probe intake and the analyte inlet, the agent probe and the analyte probe being close together to form a liquid bridge therebetween when the agent is delivered to the sample with the agent probe to form analyte ions for routing to the mass spectrometer with the analyte probe;

a positioning device including a sample support structure and a mechanism to selectively adjust distance between the instrumentation and the uneven sample surface when the sample engages the support structure;

detection equipment including a vibration stimulator to stimulate vibration of at least a portion of the instrumentation and a vibration sensor to generate a sensor signal corresponding to vibratory movement of the portion of the instrumentation; and a controller including a regulator responsive to the sensor signal to determine an instrumentation separation distance in correspondence to shear force variation of the portion of the instrumentation relative to the uneven sample surface when the sample engages the sample support structure to move therewith and generate one or more position control signals, the positioning device being responsive to the position control signals to regulate the instrumentation separation difference.

* * * * *